US009464496B2

(12) United States Patent
O'Rourke et al.

(10) Patent No.: US 9,464,496 B2
(45) Date of Patent: Oct. 11, 2016

(54) DOWNHOLE TOOL FOR REMOVING A CASING PORTION

(71) Applicant: Smith International, Inc., Houston, TX (US)

(72) Inventors: Timothy M. O'Rourke, Austin, TX (US); Jonathan Park, Ness (GB)

(73) Assignee: Smith International, Inc., Houston, TX (US)

( * ) Notice: Subject to any disclaimer, the term of this patent is extended or adjusted under 35 U.S.C. 154(b) by 215 days.

(21) Appl. No.: 14/195,542

(22) Filed: Mar. 3, 2014

(65) Prior Publication Data

US 2014/0251616 A1 Sep. 11, 2014

Related U.S. Application Data

(60) Provisional application No. 61/773,031, filed on Mar. 5, 2013, provisional application No. 61/820,023, filed on May 6, 2013.

(51) Int. Cl.

| | |
|---|---|
| ***E21B 23/01*** | (2006.01) |
| ***E21B 29/00*** | (2006.01) |
| ***E21B 31/20*** | (2006.01) |
| ***E21B 33/12*** | (2006.01) |

(52) U.S. Cl.

CPC ..... *E21B 29/005* (2013.01); *E21B 31/20* (2013.01); *E21B 33/1208* (2013.01)

(58) Field of Classification Search

CPC ..... E21B 23/01; E21B 23/02; E21B 43/04; E21B 43/25

See application file for complete search history.

(56) References Cited

U.S. PATENT DOCUMENTS 5,101,895 A * 4/1992 Gilbert ..... E21B 23/006 166/55.8
5,117,913 A 6/1992 Themig et al.
6,056,049 A * 5/2000 Davis ..... E21B 31/16 166/361

(Continued)

FOREIGN PATENT DOCUMENTS

WO 9902817 A1 1/1999
WO 03080993 A1 10/2003
WO 2011156107 A2 12/2011

OTHER PUBLICATIONS

International Search Report and Written Opinion issued in PCT/US2014/020405 on Jun. 23, 2014, 15 pages.

(Continued)

*Primary Examiner* — William P Neuder
(74) *Attorney, Agent, or Firm* — Colby Nuttall

(57) ABSTRACT

A packoff device is disclosed for sealing an annulus within a wellbore, and for bypassing the sealed annulus. The packoff device may include a mandrel having a bore formed axially therethrough and first and second ports extending radially from the bore. A sealing element that extends radially-outwardly from the mandrel may be positioned axially between the first and second ports, and may create a seal within an annulus between the mandrel and a casing, to isolate a portion of the annulus above the sealing element from a portion below the sealing element. A sleeve within the bore may, with the mandrel, form a channel providing fluid communication between the first and second ports. The sleeve may be movable between open and closed states. The first and second ports may be unobstructed by the sleeve in the open state, one or more may be obstructed in the closed state.

20 Claims, 18 Drawing Sheets

(56) References Cited

U.S. PATENT DOCUMENTS

| | | | | |
|---|---|---|---|---|
| 8,261,822 | B2 | 9/2012 | Jordy | |
| 2010/0089583 | A1* | 4/2010 | Xu | E21B 10/322 166/298 |

OTHER PUBLICATIONS

"HP Cup Range", Ruberatkins Cup Brochure, revision 15, Rubberatkins Ltd, 2012, 4 pages.

* cited by examiner

DOWNHOLE TOOL FOR REMOVING A CASING PORTION

CROSS-REFERENCE TO RELATED APPLICATIONS

This application claims the benefit of, and priority to, U.S. Patent Application Ser. No. 61/775,031, filed on Mar. 5, 2013 and entitled "DOWNHOLE TOOL FOR REMOVING A CASING PORTION," and to U.S. Patent Application Ser. No. 61/820,023 filed on May 6, 2013 and entitled "DOWNHOLE TOOL FOR REMOVING A CASING PORTION," each of which is expressly incorporated herein by this reference in its entirety.

BACKGROUND

After a wellbore ceases to produce, or the production is no longer profitable, the wellbore may become abandoned. To abandon the wellbore, a plug (e.g., a cement plug) is placed in the casing to block uphole and downhole fluid flow through the wellbore. A rotating casing cutter that is coupled to a first downhole tool is then used to make a cut above the cement plug and separate the casing into a first or upper portion and a second or lower portion.

An annulus formed between the casing and the wellbore wall, or between the casing and another, outer casing, may be filled with fluids. For instance, water, hydrocarbon liquids and/or gases, or other fluids, may be within the annulus and should be removed prior to abandonment of the wellbore. After the casing has been cut, a second downhole tool is run into the wellbore to circulate or flush these fluids out of the wellbore.

SUMMARY

Some embodiments of the present disclosure relate to a downhole tool for removing a portion of casing from a wellbore. An illustrative downhole tool may include a packoff device for sealing an annulus between the downhole tool and a casing of a wellbore. A spear may be coupled to the packoff device and configured to engage the casing to restrict relative movement between the downhole tool and the casing. A circulating sub coupled to the spear may have a port therein. The port may extend in an at least partial radial direction and be in fluid communication with the annulus. A casing cutter may be coupled to the circulating sub and configured to cut the casing.

A method for removing a casing from a wellbore is also disclosed, and in one or more embodiments includes running a downhole tool into a first casing. The downhole tool may include a packoff device, a spear, a circulating sub, and a casing cutter. The spear may be engaged with the first casing to restrict relative movement therebetween, and the first casing may be cut using the casing cutter. Cutting the first casing may include forming an opening in the casing, and defining upper and lower portions of the casing. An annulus between the downhole tool and the first casing may be sealed using the packoff device, which is optionally positioned above the spear, the circulating sub, and the casing cutter relative to the surface of the wellbore. Drilling fluid may be flowed through a port in the circulating sub and into the first annulus. At least some of the drilling fluid may flow from the first annulus, through the opening formed between the upper and lower portions of the first casing, and into a second annulus formed between the first casing and a second casing.

The upper portion of the first casing may be pulled out of the wellbore after flowing drilling fluid into the second annulus.

In one or more additional embodiments, a method for removing casing from a wellbore may include running a downhole tool into a first casing. The downhole tool may include a packoff device, a spear, a circulating sub, and a casing cutter. The spear may be used to restrict relative movement between the downhole tool and the first casing, and thereafter the casing cutter may be used to form an opening in the first casing. The opening may define a separation between upper and lower portions of the first casing. A port in the circulating sub may be opened. The port may provide a path of fluid communication between an axial bore in the downhole tool and a first annulus between the downhole tool and the first casing. Optionally, the circulating sub may be positioned between the spear and the casing cutter. After the port is opened, the spear may be disengaged from the casing and the downhole tool may be moved relative to the first casing. The first annulus may be sealed with the packoff device, with the seal be positioned potentially above the spear. Drilling fluid may be flowed through the port in the circulating sub and into the first annulus. Such flow may occur when the packoff device seals the first annulus, with at least a portion of the drilling fluid flowing from the first annulus, through the opening formed between the upper and lower portions of the first casing, and into a second annulus formed between the first casing and a second casing. The spear may be activated to restrict relative movement between the downhole tool and the upper portion of the first casing after flow of drilling fluid into the second annulus, and the upper portion of the first casing may be pulled out of the wellbore.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

So that the recited features may be understood in detail, a more particular description, briefly summarized above, may be had by reference to one or more embodiments, some of which are illustrated in the appended drawings. It is to be noted, however, that the appended drawings are illustrative embodiments, and are, therefore, not to be considered limiting of its scope.

DETAILED DESCRIPTION

Some embodiments described herein generally relate to downhole tools. More particularly, some embodiments of the present disclosure relate to downhole tools for removing a casing from a wellbore after the wellbore has been abandoned. More particularly still, some embodiments of the present disclosure relate to methods, systems, assemblies, and downhole tools for removing a casing from a wellbore and circulating fluids out of the wellbore in a single downhole trip.

Figure 1:
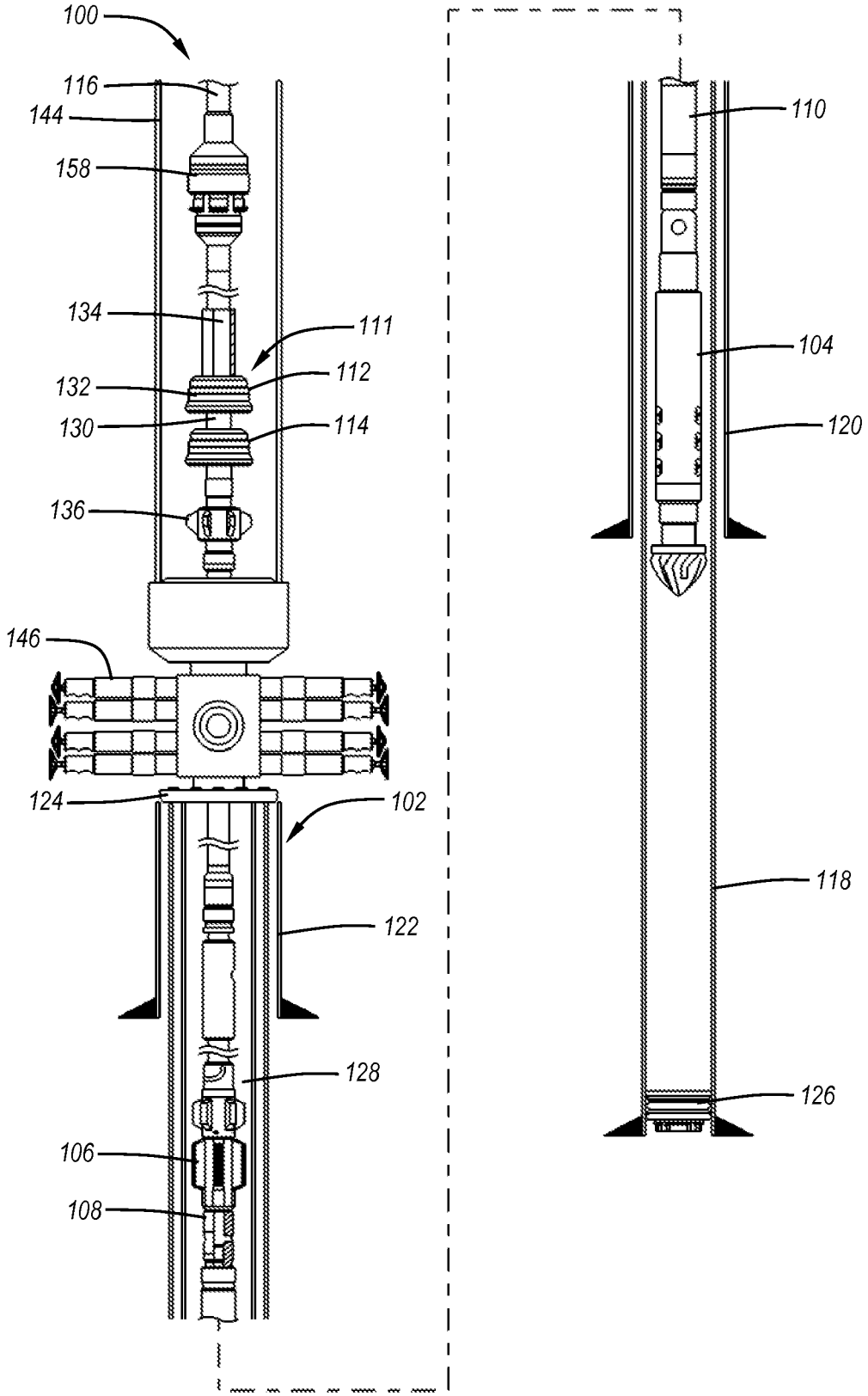
FIG. 1 schematically illustrates a side view of a downhole tool in a wellbore, the downhole tool being in a run-in position prior to cutting a wellbore casing, according to one or more embodiments of the present disclosure.

FIG. 1 depicts a schematic side view of a downhole tool 100 within a wellbore 102 according to one or more embodiments of the present disclosure. As shown in FIG. 1, the downhole tool 100 may include various components. For instance, the downhole tool 100 may include a casing cutter 104 and/or a spear 106 in some embodiments. Other illustrative components of the downhole tool 100 may include a circulating sub 108, a motor 110, and a packoff assembly 111. In some embodiments, the packoff assembly 111 may include one or more packoff devices (two are shown as packoff devices 112, 114). A tubular component such as drill pipe or a work string 116 may connect to the downhole tool 100 to facilitate use of the downhole tool 100, including insertion of the downhole tool 100 into the wellbore 102 and removal of the downhole tool 100 from the wellbore 102. The downhole tool 100 may also include other components in other embodiments. For instance, some embodiments contemplate a downhole tool 100 that includes one or more bumper subs, jars, jetted subs, drill bits, mill bits, drill collars, string magnets, ball catching subs, crossovers, bit subs, or other components, or any combination of the foregoing.

In accordance with at least some embodiments, the wellbore 102 may be a cased wellbore having one or more casings (three are shown as casings 118, 120, 122) installed therein. In the particular, the casings 118, 120, 122 may extend from a wellhead 124 downward into the wellbore 102. As shown, a first or inner casing 118 may be disposed at least partially within a second or intermediate casing 120. The second casing 120 may be disposed at least partially within a third or outer casing 122. The diameter or width of each casing 118, 120, 122 may change, and in FIG. 1 the first casing 118 may have a smaller diameter that the second casing 120, which may in turn have a smaller diameter than the third casing 122. In accordance with at least some embodiments, a plug 126, which may be a cement plug, a bridge plug, or some other type of plug, may be disposed within the first casing 118 and positioned a distance below the downhole tool 100 prior to the downhole tool 100 being lowered into the wellbore 102. In other embodiments, the downhole tool 100 may be or include a cementing tool or the like and may be used to set the plug 126. In some embodiments, the plug 126 may restrict and potentially prevent fluid flow in both axial directions (i.e., uphole and downhole directions) through the first casing 118.

The downhole tool 100 may be in a run-in position when inserted into the wellbore 102. The run-in position may correspond to a retracted or other position of the casing cutter 104, which may be a position of the casing cutter 104 prior to cutting the first casing 118. In the run-in position, the spear 106 may also be in a retracted or other similar position, which may be a position in which the spear 106 is not engaged with the first casing 118.

Any number of packoff devices 112, 114 may be used in accordance with various embodiments of the present disclosure. The packoff devices 112, 114 may be configured to form a seal between the downhole tool 100 and the casing 118 to restrict, and potentially prevent, fluid flow in at least one direction through an annulus 128 formed between the downhole tool 100 and the interior surface of the casing 118. In one embodiment, the packoff devices 112, 114 may be configured or otherwise designed to restrict or even prevent fluid flow in one direction (e.g., an upward or uphole direction) through the annulus 128. In another embodiment, the packoff devices 112, 114 may be configured or otherwise designed to restrict or even prevent fluid flow in both axial directions (e.g., upward/uphole and downward/downhole) through the annulus 128. The packoff devices 112, 114 may withstand fluid pressure as desirable for a wellbore operation. For instance, the packoff devices 112, 114 may withstand pressures up to about 5 MPa (725 psi), about 10 MPa (1,450 psi), about 25 MPa (3,635 psi), about 50 MPa (7,250 psi), about 75 MPa (10,875 psi), about 100 MPa (14,500 psi), about 125 MPa (18,125 psi), about 150 MPa (21,750 psi), or even more.

In at least some embodiments, the packoff device 112, 114 may include or be coupled to a body or mandrel 130 and/or a malleable sealing element 132. In some embodiments, the malleable sealing element 132 may take the form of sealing lips. The mandrel 130 may be substantially cylindrical in some embodiments, and may have a cavity or bore 134 formed axially therethrough. The mandrel 130 may be made of any suitable materials, including one or more metals or metal alloys (e.g., steel, titanium, etc.), composite materials, organic materials, polymeric materials, or the like. In some embodiments, the sealing element 132 may be disposed proximate the top portion of the mandrel 130 and/or radially-outward from the mandrel 130. The sealing element 132 may face upwardly toward the surface or downwardly toward the spear 106 and/or the casing cutter 104. The sealing element 132 may be made of any material capable of sealing the annulus 128, and in some embodiments may include one or more polymers, elastomers, rubber materials, or the like. For example, the sealing element 132 may be made of silicone, nitrile butadiene rubber, hydrogenated nitrile butadiene rubber, other materials, or some combination of the foregoing. When the cavity or bore 134 is pressurized, the pressure may cause a force to be exerted on the sealing element 132 that causes the sealing element 132 to form a seal with the casing 118 (see FIG. 7). The packoff devices 112, 114 may be or include swab cups or the like, such as those manufactured and sold by Rubberatkins Ltd. based in Aberdeen, United Kingdom.

The outer diameter of the packoff devices 112, 114 may be different for a number of different applications or systems, may in some embodiments be based on the size of the first casing 100, 118. For instance, the outer diameter of the packoff devices 112, 114 may range from a low of about 5 cm (2 in.), about 10 cm (3.9 in.), about 15 cm (5.9 in.), about 20 cm (7.9 in.), about 25 cm (9.8 in.), or about 30 cm (11.8 in.) to a high of about 40 cm (15.7 in.), about 50 cm (19.7 in.), about 60 cm (23.6 in.), about 70 cm (27.6 in.), about 80 cm (31.5 in.), 156 cm (47.2 in.), 150 cm (59.1 in.), or more. For example, the outer diameter of the packoff devices 112, 114 and/or the inner diameter of the first casing 118 may be between about 5 cm (2 in.) and about 15 cm (5.9 in.), between about 10 cm (3.9 in.) and about 20 cm (7.9 in.), between about 15 cm (5.9 in.) and about 30 cm (11.8 in.), between about 20 cm (7.9 in.) and about 40 cm (15.7 in.), between about 30 cm (11.8 in.) and about 50 cm (19.7 in.), between about 40 cm (15.7 in.) and about 70 cm (27.6 in.), or greater than 70 cm (27.6 in.). In at least one embodiment, the outer diameter of the packoff devices 112, 114 may vary along the axial length thereof. For instance, a first axial end portion of each packoff device 112, 114 (e.g., a downhole end portion) may have a greater outer diameter than a second axial end portion of the packoff device 112, 114 (e.g., an uphole end portion).

Figure 7:
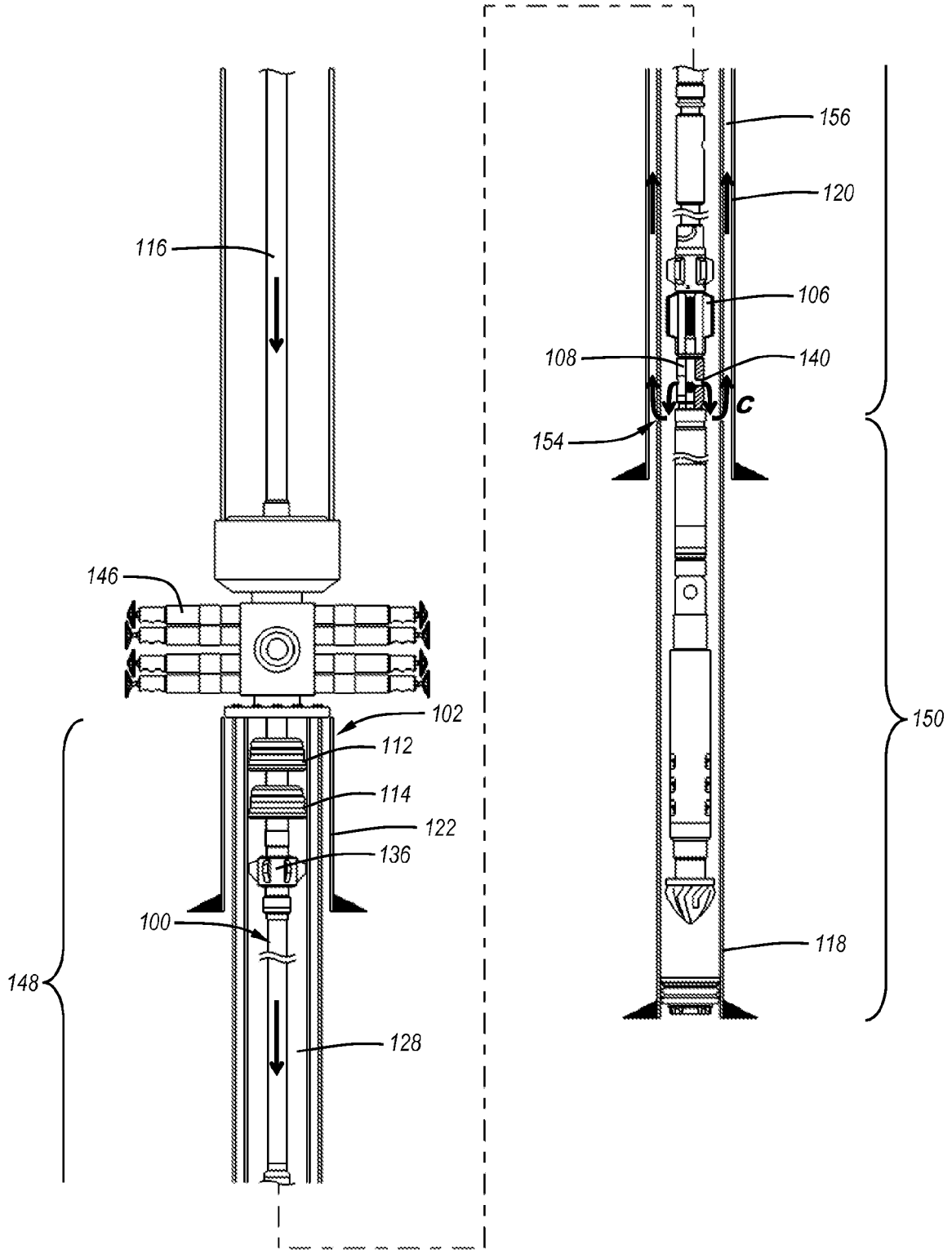
FIG. 7 schematically illustrates a side view of a downhole tool used to flow drilling fluid through a port in the circulating sub and into an annulus between wellbore casing and a formation or outer casing, according to one or more embodiments of the present disclosure.

In accordance with at least some embodiments of the present disclosure, a cup stabilizer 136 may be coupled to the packoff devices 112, 114 or the work string 116. As shown in FIG. 1, the cup stabilizer 136 may be positioned below or downhole relative to the packoff devices 112, 114. The cup stabilizer 136 may be used to maintain the alignment of the downhole tool 100 within the casing 118 (e.g., when the cup stabilizer 136 is disposed within the casing 118 as shown in FIG. 7). In addition, the cup stabilizer 136 may reduce the vibration experienced by the downhole tool 100 and help guide the packoff devices 112, 114 through the wellhead 124 and/or the first casing 118. The cup stabilizer 136 may be sized, shaped, or otherwise configured to minimize lateral movement of the packoff devices 112, 114 and to allow flow circulation within the annulus 128.

The spear 106 of some embodiments of the present disclosure may be included within the downhole tool 100 and may be coupled to the work string 116 and positioned below the cup stabilizer 136 and/or the packoff devices 112, 114. For example, the spear 106 may be coupled to the cup stabilizer 136 and/or the packoff devices 112, 114 via one or more segments of the drill pipe or work string 116. A distance between the packoff devices 112, 114 and the spear 106 may, in some embodiments, be between about 0.25 m (0.8 ft.) and about 1 m (3.3 ft.), between about 1 m (3.3 ft.) and about 2 m (6.6 ft.), between about 2 m (6.6 ft.) and about 5 m (16.4 ft.), between about 5 m (16.4 ft.) and about 10 m (32.8 ft.), between about 10 m (32.8 ft.) and about 20 m (65.6 ft.), between about 20 m (65.6 ft.) and about 50 m (165 ft.), between about 50 m (165 ft.) and about 150 m (490 ft.), or greater than 150 m (490 ft.). The spear 106 may include one or more arms 138 or other latching devices (see FIG. 2) configured or otherwise designed to expand radially-outward to engage the casing 118. Once engaged, the spear 106 may substantially lock the downhole tool 100 at a particular axial position within the first casing 118 by restricting or even preventing axial movement between the downhole tool 100 and the first casing 118.

The circulating sub 108 may be coupled to spear 106 and/or the work string 116, and in some embodiments may be positioned below the spear 106. The circulating sub 108 may be substantially cylindrical with a bore formed axially through at least a portion thereof, and potentially through the entire circulating sub 108. The circulating sub 108 may have one or more ports 140 (see FIG. 5) formed at least partially radially therethrough, and which may provide a path of fluid communication between the bore of the circulating sub 108 and the annulus 128. For example, the circulating sub 108 may have a plurality of ports 140 that are circumferentially-offset from one another, and which may be at the same or different axial positions within the circulating sub 108. The circulating sub 108 may be configured or otherwise designed to actuate from an inactive state to an active state. When the circulating sub 108 is in the inactive state, the ports 140 may be blocked such that fluid may not flow therethrough and into the annulus 128. When the circulating sub 108 is in the active state, the ports 140 may be unobstructed, and fluid may flow therethrough and into the annulus 128.

Figure 4:
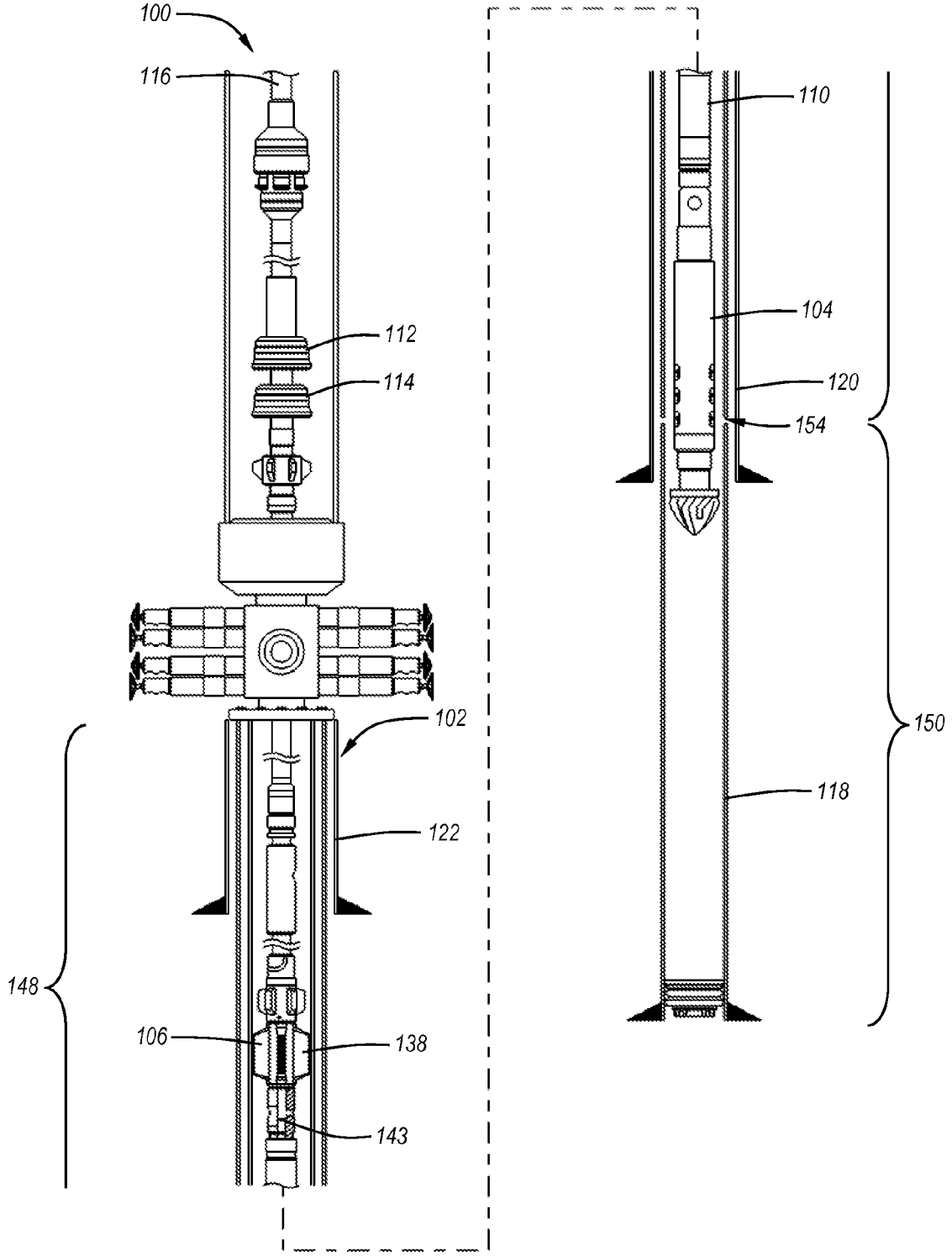
FIG. 4 schematically illustrates a side view of a downhole tool within a wellbore, and after the wellbore casing is cut by a casing cutter, according to one or more embodiments of the present disclosure.
Figure 5:
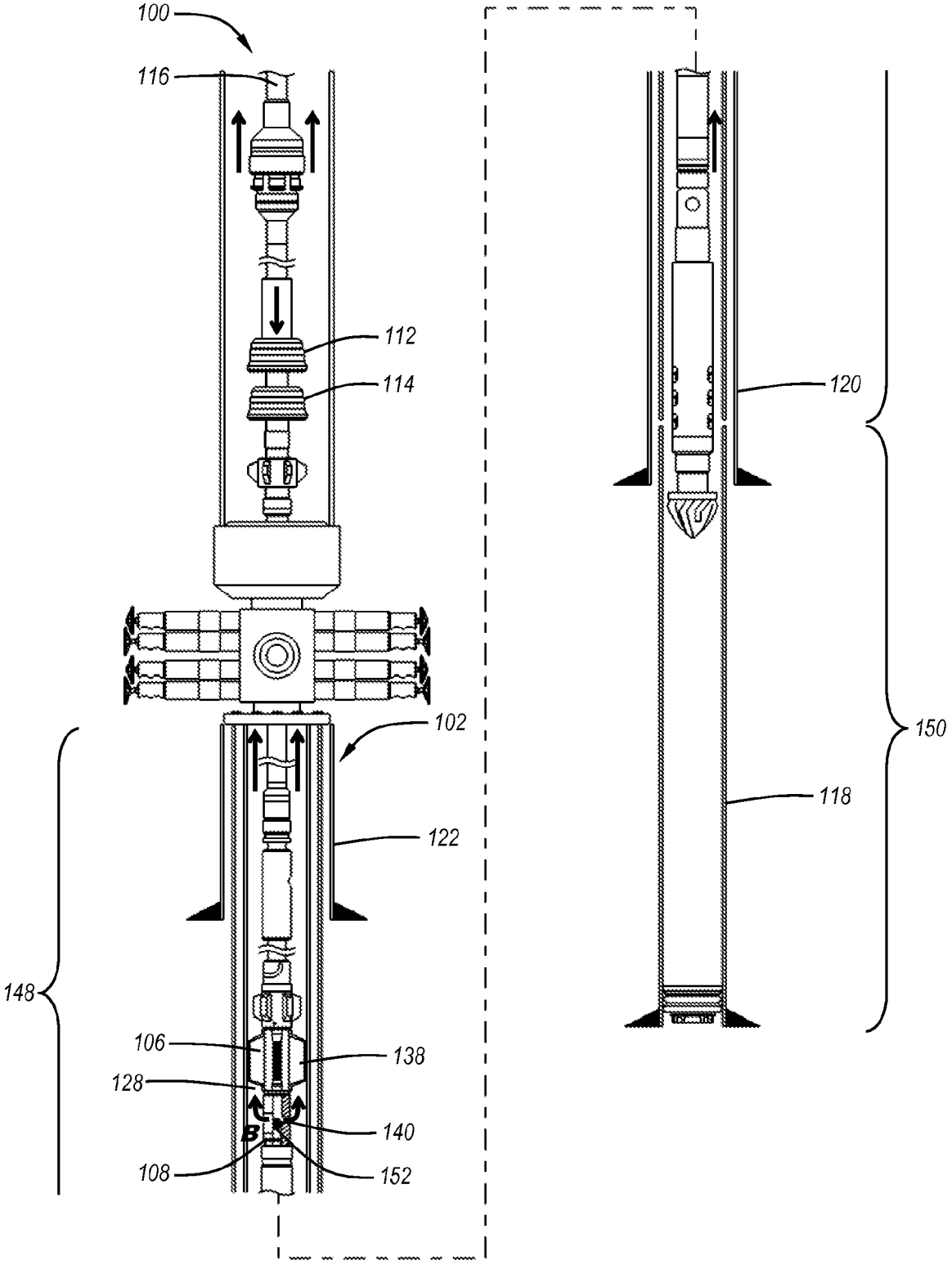
FIG. 5 schematically illustrates a side view of a downhole tool used to flow drilling fluid flowing through a port in a circulating sub and into an annulus between the wellbore casing and the downhole tool, according to one or more embodiments of the present disclosure.

The circulating sub 108 may have a seat 143 (see FIG. 4) disposed therein that is configured or otherwise designed to receive an impediment 152 such as a ball, dart, or the like (see FIG. 5). When the impediment 152 is received in the seat 143, a pump (not shown) may cause drilling fluid to flow down the work string 116 and into the downhole tool 100. In some embodiments, the pump may be disposed on or proximate to a drilling rig at the surface. As used herein, the term "drilling fluid" includes any drilling fluid known in the art, such as air, an air/water mixture, an air/polymer mixture (e.g., a foaming agent), water, water-based mud or "gel"

(e.g., bentonite), oil-based mud, synthetic-based fluid, other fluid, or any combination of the foregoing.

The engagement between the impediment and the seat 143 may restrict or even prevents the drilling fluid from flowing axially through the circulating sub 108. As the pump continues to operate, the pressure of the drilling fluid within the circulating sub 108 may increase, which can actuate the circulating sub 108 from the inactive state to the active state. Such activation result from bursting a burst disk or other flow restriction element, shearing a shear screw, responding to an increased pressure, or in other manners. Actuating the circulating sub 108 may be used for a variety of different purposes. For instance, actuating the circulating sub 108 to transition to the active state may be used to open the one or more ports 140 (see FIG. 5), expand the spear 108, etc. In some embodiments, multiple impediments may be used to perform different actions and/or multiple circulating subs 108, activation subs, or the like may be used.

A motor 110 may be coupled to the circulating sub 108 and/or work string 116 in some embodiments. As shown in FIG. 1, the motor 134 may be positioned below the circulating sub 108. In accordance with some embodiments, the motor 110 may be a positive displacement motor or a "mud motor," although in other embodiments an electrical motor, magnetic drive, or other motor may be used. In the case of a mud motor, when drilling fluid is pumped downward through the downhole tool 100, the motor 110 can convert energy from the flowing drilling fluid to rotational mechanical energy. In some embodiments, the rotational mechanical energy may be used to rotate the casing cutter 104 about a longitudinal axis extending therethrough.

Figure 3:
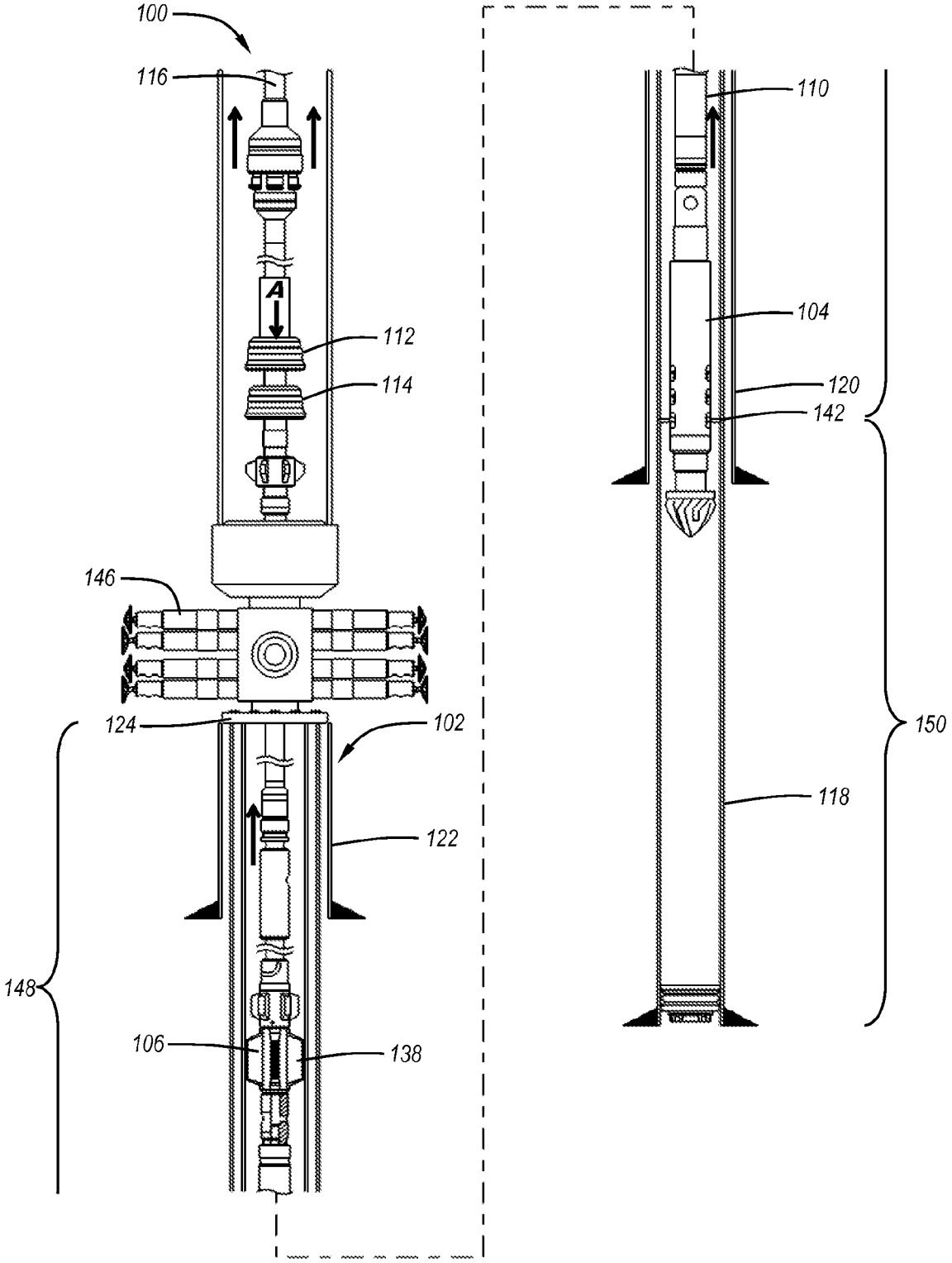
FIG. 3 schematically illustrates a side view of a downhole tool that includes a casing cutter for cutting the wellbore casing, according to one or more embodiments of the present disclosure.

A pipe cutter (e.g., the casing cutter 104) may be coupled to the work string 116, the motor 110, the circulating sub 108, or some combination of the foregoing. As shown in FIG. 1, the casing cutter 104 may in some embodiments be positioned below the motor 110 and/or the circulating sub 108. The casing cutter 104 may include one or more blades 142 (see FIG. 3) arranged circumferentially and/or axially along the body of the casing cutter 104. For instance, the casing cutter 104 may include a multi-cycle casing cutter with axially offset blades 142, and which may be cycled to independently expand some blades 142 while others remain retracted. As shown in FIG. 3, for instance, the distal-most set of blades 142 may be expanded while one or more other more proximal or uphole sets of blades 142 remain retracted.

The blades 142 may be configured or otherwise designed to actuate from an inactive state (FIG. 1) to an active state (FIG. 3) when the drilling fluid is being pumped downwardly through the downhole tool 100. When the casing cutter 104 actuates from the inactive state to the active state, the blades 142 may expand radially-outwardly to engage the first casing 118.

An example manner in which the downhole tool 100 may be used within the wellbore 102 is illustrated in, and described in greater detail with reference to, FIGS. 1-8. As shown in FIG. 1, the downhole tool 100 may be lowered through a riser 144 and into the wellbore 102. A blow-out preventer ("BOP") 146 may be disposed proximate the lower end portion of the riser 144, and the wellhead 124 may be disposed below the blow-out preventer 146. In FIG. 1, the downhole tool 100 is shown in an inactive or run-in state in which the casing cutter 104 and/or spear 106 may be in retracted positions.

Figure 2:
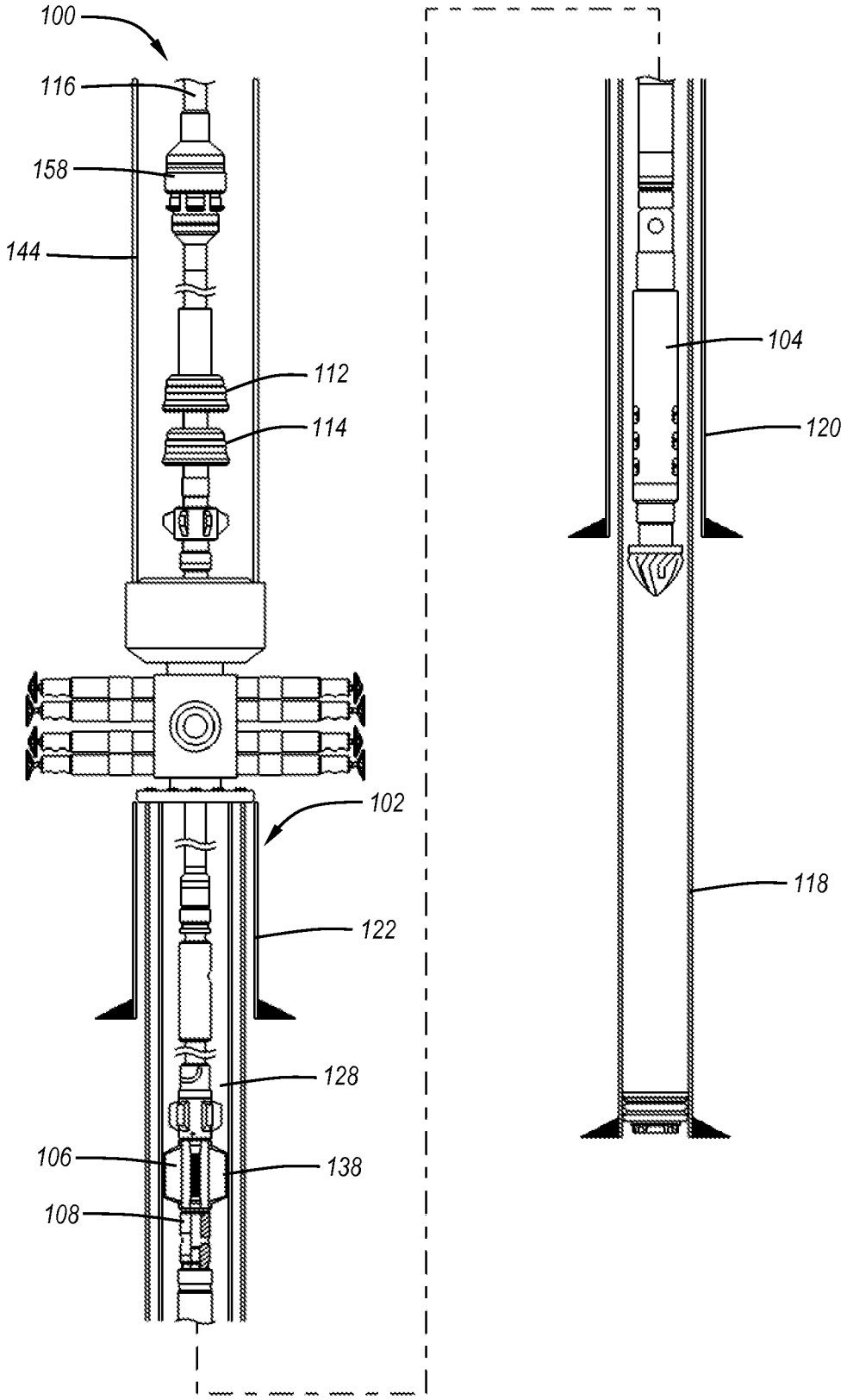
FIG. 2 schematically illustrates a side view of a downhole tool that includes a spear engaging the wellbore casing, according to one or more embodiments of the present disclosure.

FIG. 2 schematically illustrates an example side view of the downhole tool 100, and particularly illustrates an example embodiment in which the spear 106 may be activated to engage the first casing 118. By engaging the first casing 118, the spear 106 may restrict or even prevent relative movement between the downhole tool 100 and the first casing 118, according to one or more embodiments. The downhole tool 100 may be run into the wellbore 102 until the spear 106 and the casing cutter 104 are both disposed within the first casing 118; however, the packoff devices 112, 114 may remain outside of the wellbore 102 and/or the first casing 118. Rather, the packoff devices 112, 114 may be positioned in the riser 144 above the first casing 118. Once the downhole tool 100 is at the desired depth, the downhole tool 100 may be lifted and rotated (e.g., clockwise or counterclockwise), which may cause the arms 138 of the spear 106 to expand radially-outwardly to engage the first casing 118. The engagement may restrict and substantially prevent axial movement between the downhole tool 100 and the first casing 118.

FIG. 3 schematically illustrates a side view of the downhole tool 100 within the wellbore 102 when the casing cutter 104 of the downhole tool 100 is activated to cut the first casing 118. In this particular embodiment, the blades 142 of the casing cutter 104 may be expanded radially outwardly and rotated to cut the first casing 118 into upper and lower portions 148, 150, according to one or more embodiments. Once the downhole tool 100 is secured to the first casing 118 via the spear 106, the pump (not shown) may cause the drilling fluid to flow down through the drill pipe or work string 116 and into the downhole tool 100, as shown by the arrow A in FIG. 3. As the drilling fluid flows downwardly through the casing cutter 104, the blades 142 may expand radially outwardly and into engagement with the first casing 118. Further, as the drilling fluid flows downwardly through the motor 110, the motor 110 may cause the casing cutter 104 to rotate about a longitudinal axis extending therethrough. When the blades 142 are in contact with the first casing 118 and rotate about the longitudinal axis extending through the casing cutter 104, the blades 142 may cut the first casing 118 into two portions. In particular, the first casing 118 may be cut into a first or upper portion 148 and a second or lower portion 150. As may be appreciated, in some embodiments, the wellbore 102 may be deviated or horizontal. In such instances, the first or upper portion of the casing 118 may be the portion nearer to the wellhead 124 or the blow-out preventer 146 than the second or lower portion.

FIG. 4 schematically illustrates a side view of the wellbore 102 and the downhole tool 102, and particularly shows the first casing 118 after it has been cut into the upper and lower portions 148, 150, according to one or more embodiments. In this particular embodiment, the casing cutter 104 is also shown as having been deactivated or retracted.

More particularly, once the first casing 118 has been cut into the upper and lower portions 148, 150, the pump may be turned off to stop the flow of the drilling fluid through the work string 116 and the downhole tool 100. In another embodiment, the pump may remain on, but the amount/rate of the drilling fluid flowing through the work string 116 and the downhole tool 100 may be decreased. Once the downward flow of drilling fluid through the work string 116 and the downhole tool 100 decreases or stops, the blades 142 (see FIG. 3) of the casing cutter 104 may actuate back into the inactive state. Optionally, the motor 110 may also no longer cause the casing cutter 104 to rotate, or may rotate the casing cutter 104 at a reduced rotational speed. When the casing cutter 104 actuates into the inactive state, the blades 142 may retract radially inwardly, and potentially into the body of the casing cutter 104, such that they are no longer in contact with the first casing 118.

FIG. 5 schematically illustrates a side view of the wellbore 102 and the downhole tool 100, and illustrates an example embodiment in which drilling fluid may flow out through the port 140 in the circulating sub 108 and into the first annulus 128, according to one or more embodiments. When the casing cutter 104 is in the inactive state, an impediment 152 (e.g., a ball, dart, etc.) may be introduced into the downhole tool 100. In at least one embodiment, the impediment 152 may be dropped into the work string 116 from the surface and travel downward through the work string 116 and into the downhole tool 100. The impediment 152 may come to rest in the seat 143 (see FIG. 4) disposed within the circulating sub 108. Optionally, the impediment 152 may be degradable at a predetermined temperature, pressure, pH, or the like. In another embodiment, the impediment 152 may pass through the seat 143 when exposed to a predetermined pressure.

When the impediment 152 is in the seat 143, the pump may once again be turned on, and/or the amount/rate of the drilling fluid flowing through the work string 116 and the downhole tool 100 may be increased. The impediment 152 may obstruct the downward flow of the drilling fluid through the circulating sub 108, which may increase the pressure of the drilling fluid in the circulating sub 108. The increased pressure may cause one or more shear elements, such as shear pins, burst discs, or the like to break, thereby opening the ports 140 in the circulating sub 108. In another embodiment, the ports 140 may be opened or uncovered via movement of a sliding sleeve or other mechanical device in response to increased pressure. Once the ports 140 are open, the drilling fluid that is pumped downwardly through the downhole tool 100 may flow radially outwardly through the ports 140 and into the first annulus 128 formed between the downhole tool 100 and the first casing 118, as shown by the arrows B.

Figure 6:
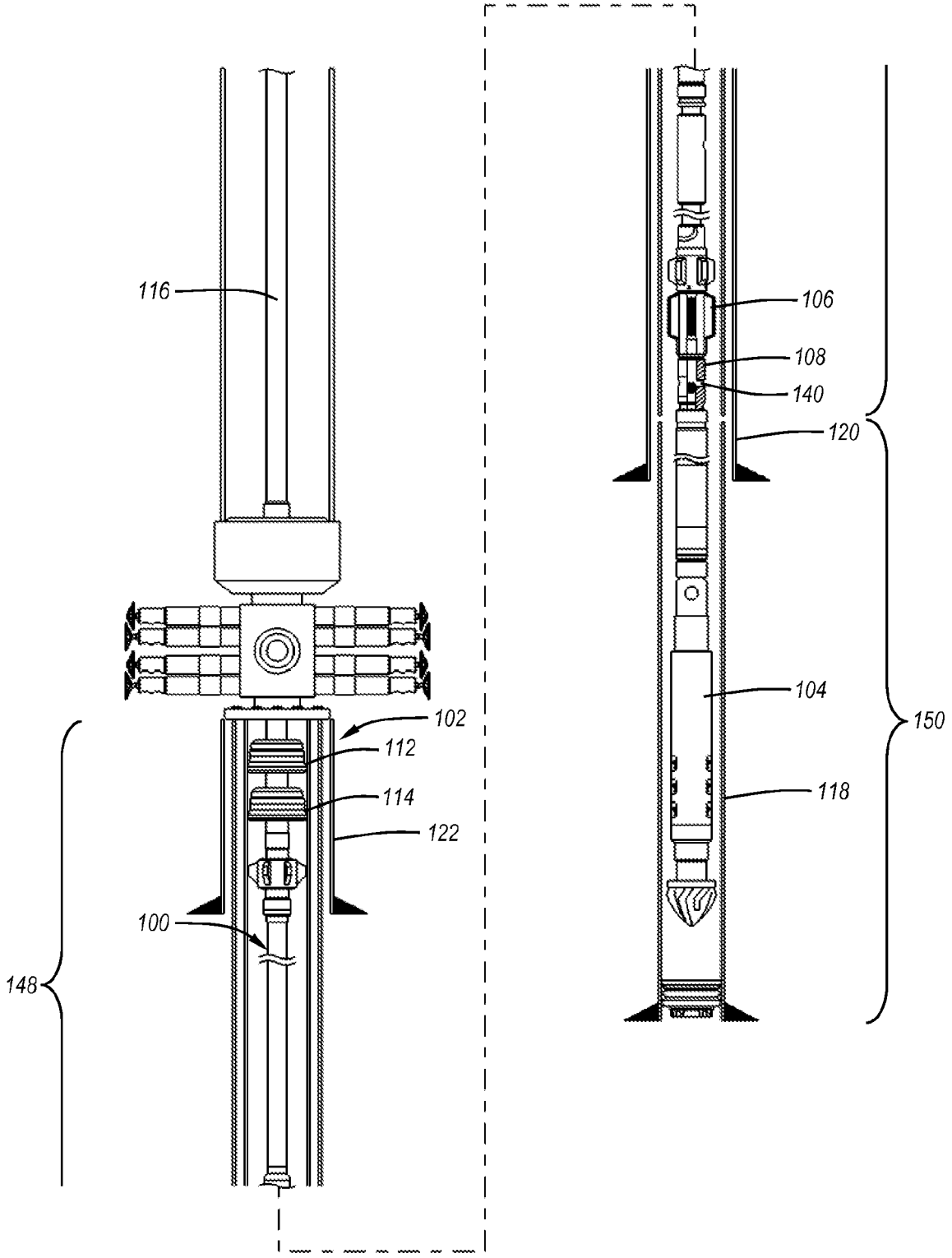
FIG. 6 schematically illustrates a side view of a downhole tool being lowered into a wellbore to position one or more packoff devices within the wellbore casing, according to one or more embodiments of the present disclosure.

FIG. 6 schematically illustrates a side view of the downhole tool 100 as it is being lowered into the wellbore 102 to position in which the packoff devices 112, 114 may be positioned within the first casing 118, according to one or more embodiments of the present disclosure. Once the ports 140 have been opened, tension on the downhole tool 100 may be slacked, and the downhole tool 100 may be rotated (e.g., clockwise or counterclockwise), which may cause the arms 138 (see FIG. 5) of the spear 106 to disengage the first casing 118. The arms 138 may also be disengaged in other manners, such as by decreasing fluid pressure, degrading a drop ball or other impediment, or passing an impediment through a seat (e.g., above a particular pressure). Disengaging the arms 138 may allow the downhole tool 100 to move axially with respect to the first casing 118. In another embodiment, the arms 138 of the spear 106 may disengage the first casing 118 before the ports 140 are opened. After the arms 138 of the spear 106 disengage the first casing 118, the work string 116 may lower the downhole tool 100 further into the wellbore 102.

FIG. 7 schematically illustrates a side view of the downhole tool 100 within the wellbore 102 when drilling fluid flows through a port 140 in the circulating sub 108 and into a second annulus 156, according to one or more embodiments of the present disclosure. The downhole tool 100 may be lowered until the packoff devices 112, 114 are disposed within the upper portion 148 of the first casing 118. When disposed within the first casing 118, the packoff devices 112, 114 may seal the first annulus 128 between the downhole tool 100 and the first casing 118, thereby restricting and potentially preventing fluid flow in at least one direction (e.g., upwardly) through the first annulus 128. With the packoff devices 112, 114 sealing the first annulus 128, the drilling fluid flowing through the ports 140 and into the first annulus 128 may fill the first annulus 128. Additional fluid passing through the ports 140 may then flow from the first annulus 128, and through an opening 154 formed by the casing cutter 104 between the upper and lower portions 148, 150 of the first casing 118 as shown by arrows C. The fluid may then flow into the second annulus 156 formed between the first casing 118 and the second casing 120.

At least a portion of the drilling fluid flowing into the second annulus 156 may flow upwardly and potentially out of the second annulus 156. For example, the drilling fluid may flow upwardly and out of the second annulus 156 through the blow-out preventer 146 and/or through one or more so called "kill lines" (not shown). The drilling fluid flowing through the second annulus 156 may circulate or flush any existing fluids in the second annulus 156 out of the second annulus 156, leaving the second annulus 156 filled with the "clean" or "new" drilling fluid. The existing fluids (i.e., those existing in the second annulus 156 before being flushed out by the clean drilling fluid) may include liquid hydrocarbons, gaseous hydrocarbons, other fluids present in the wellbore 102 or the surrounding formation, or any combination of the foregoing.

In addition to flushing the existing fluids out of the second annulus 156, the flow of the drilling fluid through the second annulus 156 may, at least partially, erode any physical bonds (e.g., barite, cement, etc.) formed between the upper portion 148 of the first casing 118 and the second casing 120 that would otherwise hinder removal of the upper portion 148 of the first casing 118. For example, the drilling fluid may include one or more additives designed to erode the physical bonds formed between the upper portion 148 of the first casing 118 and the second casing 120.

Figure 8:
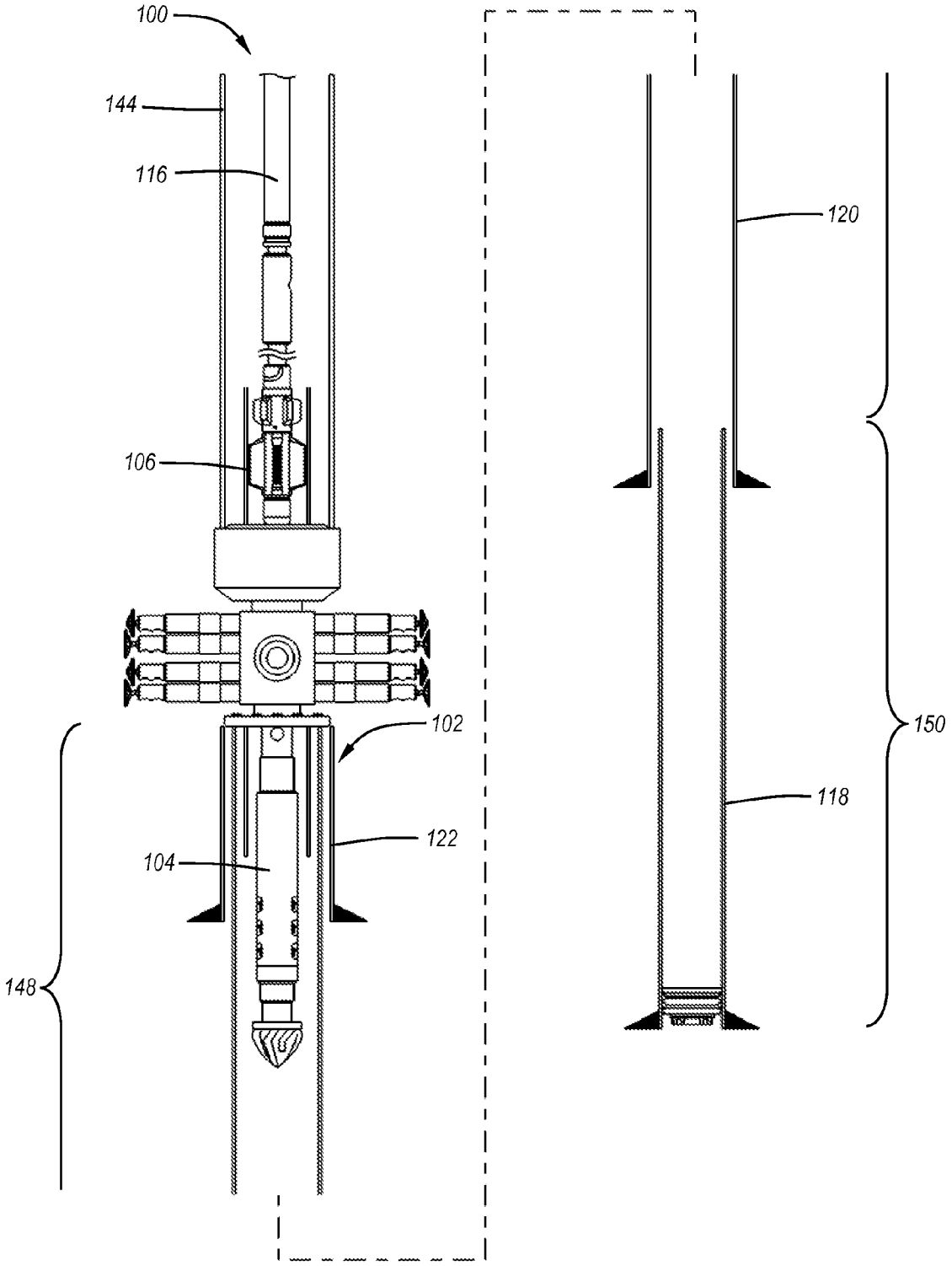
FIG. 8 schematically illustrates a downhole tool that includes a spear engaging an upper portion of wellbore casing for pulling the upper portion of the wellbore casing out of the wellbore, according to one or more embodiments of the present disclosure.

FIG. 8 schematically illustrates a side view of downhole tool 100 when the spear 106 is engaged with the upper portion 148 of the first casing 118 and the downhole tool 100 is pulling the upper portion 148 of the first casing 118 out of the wellbore 102, according to one or more embodiments of the present disclosure. After drilling fluid has circulated through the second annulus 156, the work string 116 may raise the downhole tool 100 until the spear 106 is disposed within the upper portion 148 of the first casing 118. In at least one embodiment, the spear 106 may be positioned adjacent an upper axial end portion of the upper portion 148 of the first casing 118, although in other embodiments the spear 106 may be positioned a lower axial end portion of the upper portion 148 of the first casing, or between the upper and lower axial end portions of the upper portion 148 of the first casing 118. The spear 106 may then re-engage the upper portion 148 of the first casing 118 to substantially restrict or even prevent axial movement between the downhole tool 100 and the upper portion 148 of the first casing 118.

Once the spear 106 has re-engaged the upper portion 144 of the first casing 118, the work string 116 may raise the downhole tool 100 and the upper portion 148 of the first casing 118, which may be coupled to the downhole tool 100 via the spear 106. The downhole tool 100 and the upper portion 148 of the first casing 118 may then be raised up and out of the wellbore 102. Thus, as may be appreciated, the downhole tool 100 of some embodiments of the present disclosure is capable of completing a process of cutting the first casing 118, flushing the existing fluids out of the second annulus 156, and removing the upper portion 148 of the first casing 118 from the wellbore 102 in a single trip downhole. The wellbore 102 may then be fully or partially filled with surrounding formation materials (e.g., sand or mud), and abandoned. In some embodiments, a wellhead running or retrieving tool 158 may also be used to remove and/or retrieve the wellhead 124 once the wellbore 102 is abandoned.

Figure 13:
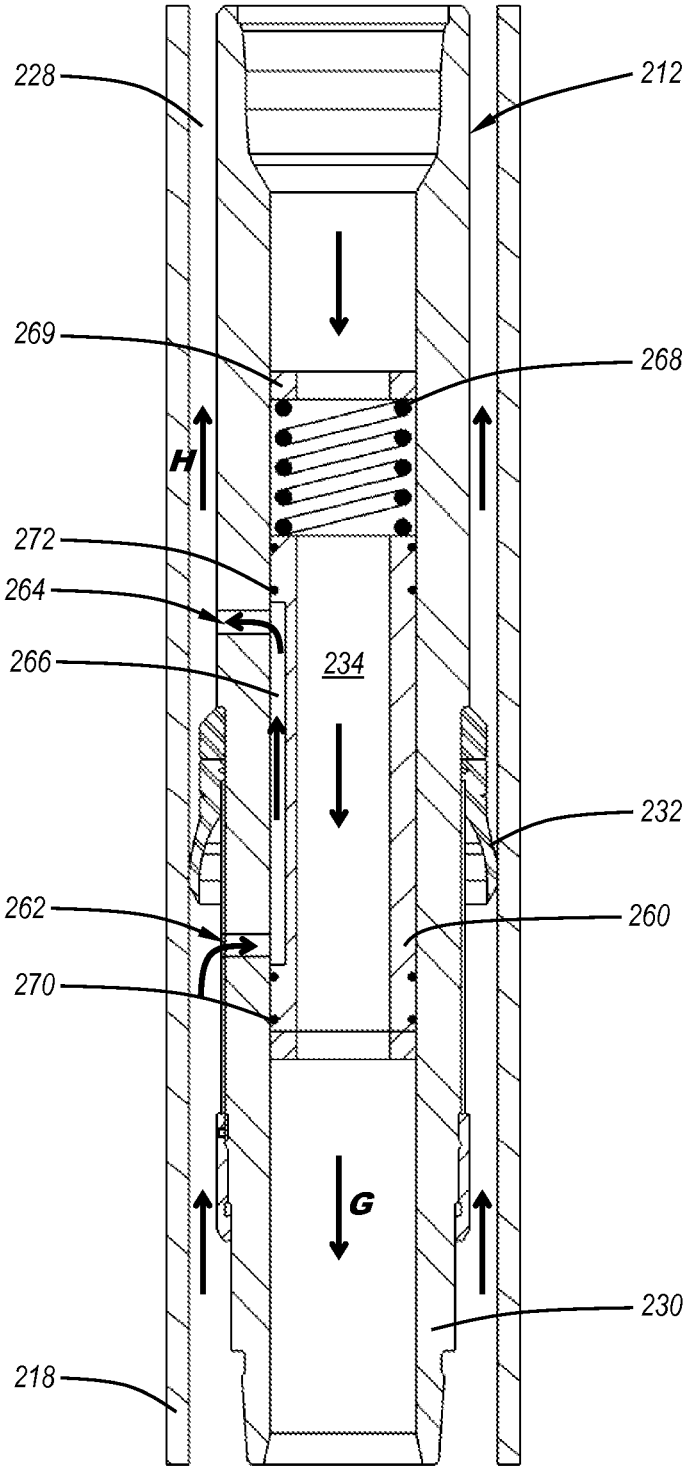
FIG. 13 depicts a cross-sectional view of a first packoff device usable in the downhole tool of FIG. 9, the first packoff device being in an open state, according to one or more embodiments of the present disclosure.
Figure 14:
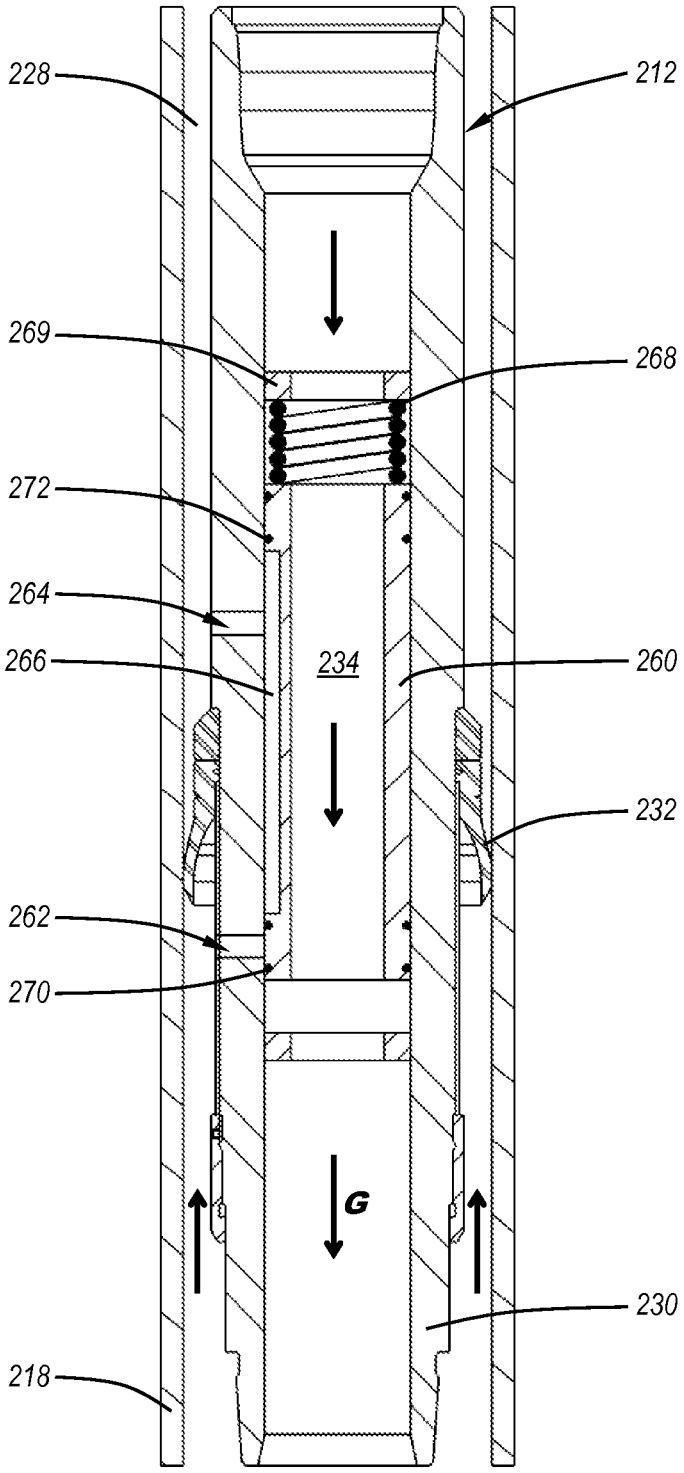
FIG. 14 depicts a cross-sectional view of a first packoff device of FIG. 13 when in a closed state, according to one or more embodiments of the present disclosure.
Figure 15:
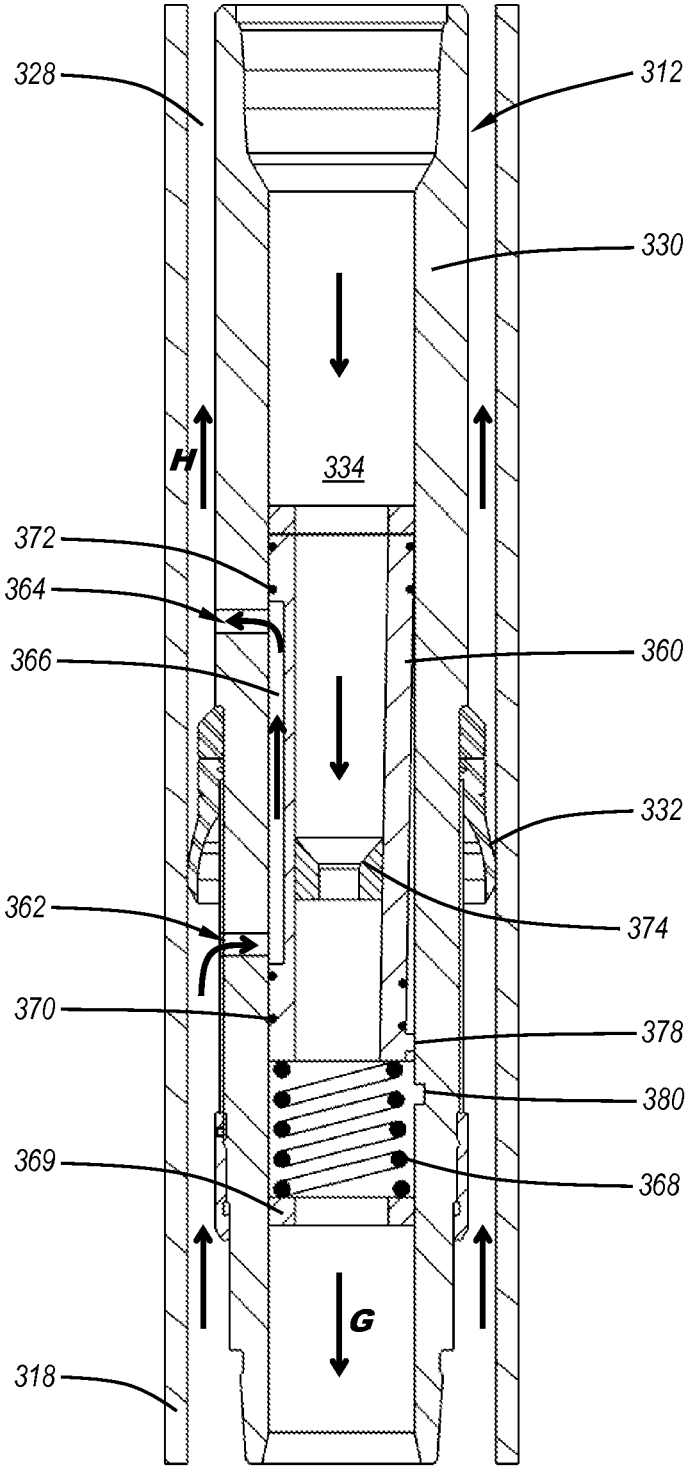
FIG. 15 depicts a cross-sectional view of another illustrative first packoff device usable in the downhole tool of FIG. 9, the first packoff device being in an open state, according to one or more embodiments of the present disclosure.
Figure 16:
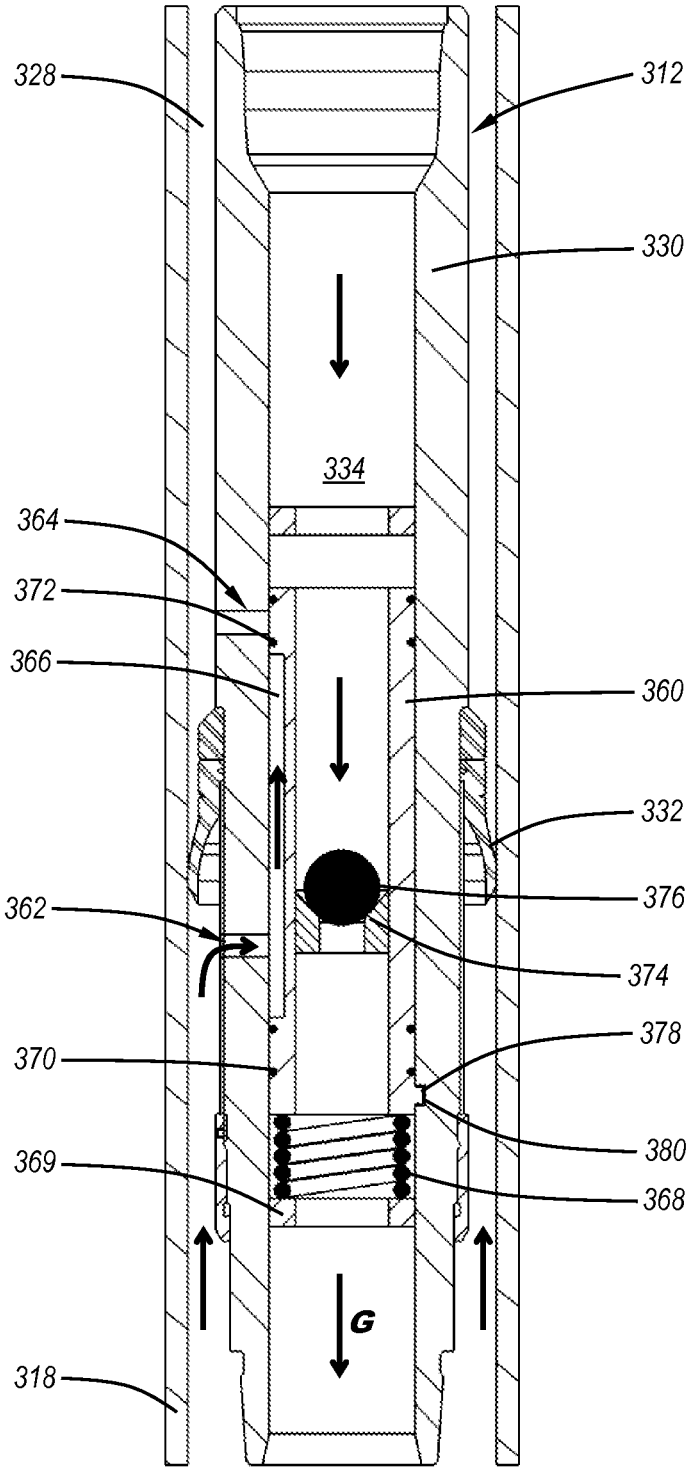
FIG. 16 depicts a cross-sectional view of a first packoff device of FIG. 15 when in a closed state, according to one or more embodiments of the present disclosure.

FIGS. 9-14, 17, and 18 show another embodiment of the operation of a downhole tool 200 in a wellbore 202, and FIGS. 15 and 16 illustrate an additional embodiment of a packoff device 300 that may be used in the operation of a downhole tool (e.g., downhole tool 100 or 200). In the embodiments of FIGS. 9-18, axial movement of the drill pipe or work string 216 and the downhole tool 200 may be reduced relative to the operation of the downhole tool of FIGS. 1-8.

Figure 9:
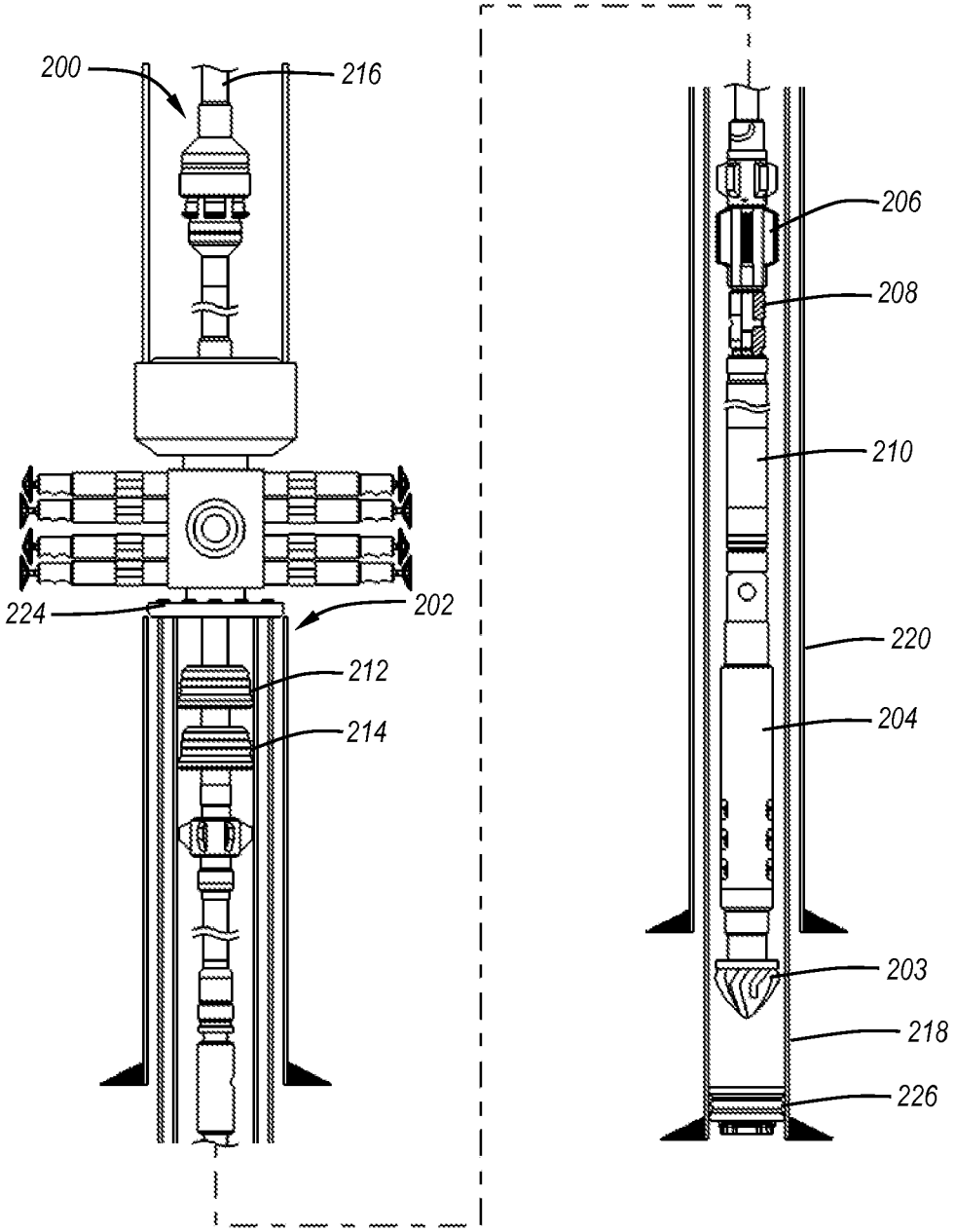
FIG. 9 schematically illustrates a side view of a downhole tool positioned within the casing of a wellbore, according to one or more embodiments of the present disclosure.

More particularly, FIG. 9 schematically illustrates a side view of the downhole tool 200 positioned within a first casing 218 in the wellbore 202, according to one or more embodiments of the present disclosure. After the plug 226 (e.g., a bridge plug, cement plug, etc.) is disposed within the first casing 208, the work string 216 may be used to lower the downhole tool 200 at least partially into the first casing 218 to a distance above the plug 226. The downhole tool 200 may be lowered until one or more packoff devices 212, 214 are disposed within the first casing 218, as shown in FIG. 9.

Figure 10:
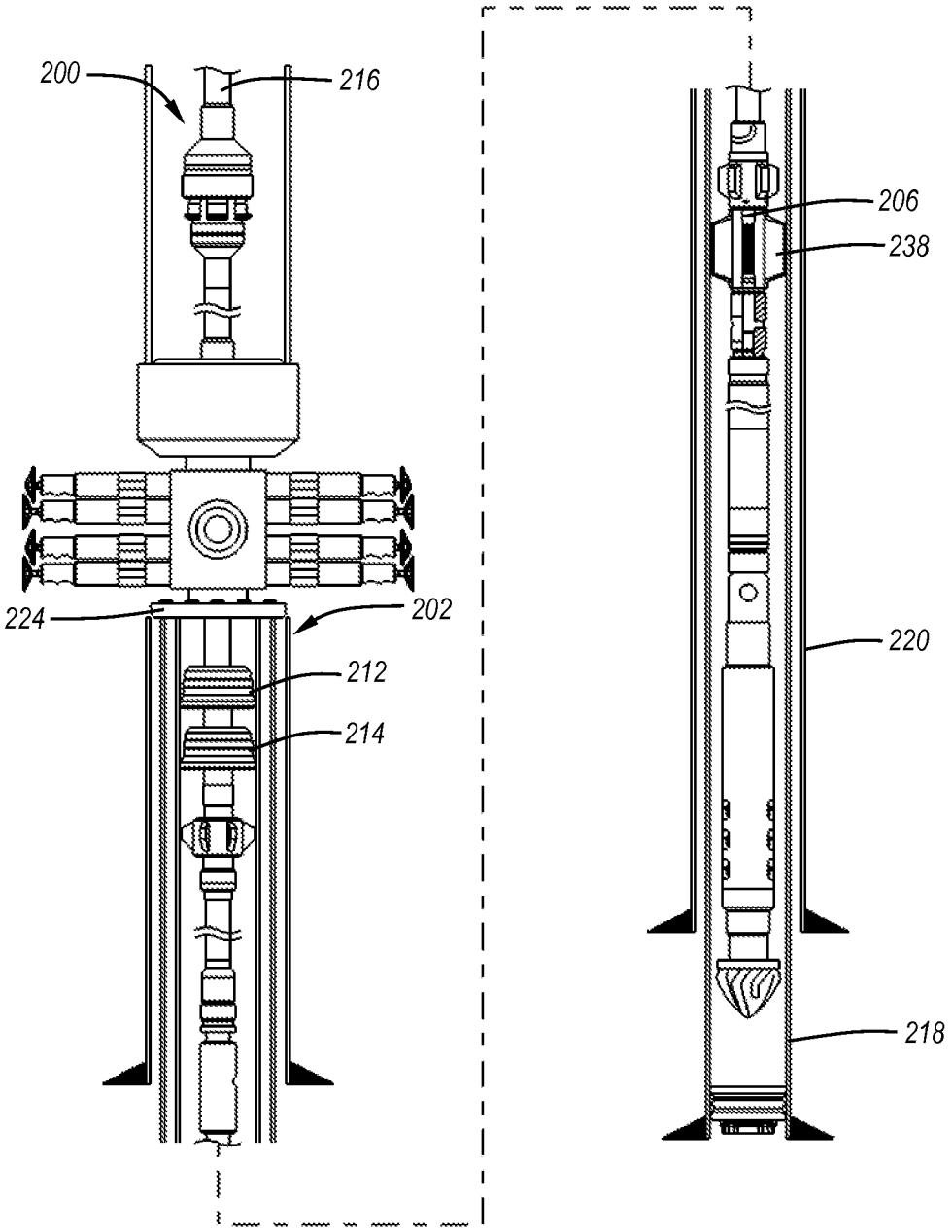
FIG. 10 schematically illustrates a side view of the downhole tool of FIG. 9 with a spear engaging the casing and restricting relative movement between the downhole tool and the casing, according to one or more embodiments of the present disclosure.

FIG. 10 schematically illustrates a side view of a spear 206 for engaging the first casing 218 to restrict, and potentially prevent, relative movement between the downhole tool 200 and the first casing 218, according to one or more embodiments of the present disclosure. Once the downhole tool 200 is at a desired depth within the wellbore 202, the downhole tool 200 may be lifted and rotated (e.g., clockwise or counterclockwise), which may cause one or more arms 238 of the spear 206 to expand radially-outwardly and engage the first casing 218. Such engagement may restrict or even substantially prevent axial movement between the downhole tool 200 and the first casing 218.

Figure 11:
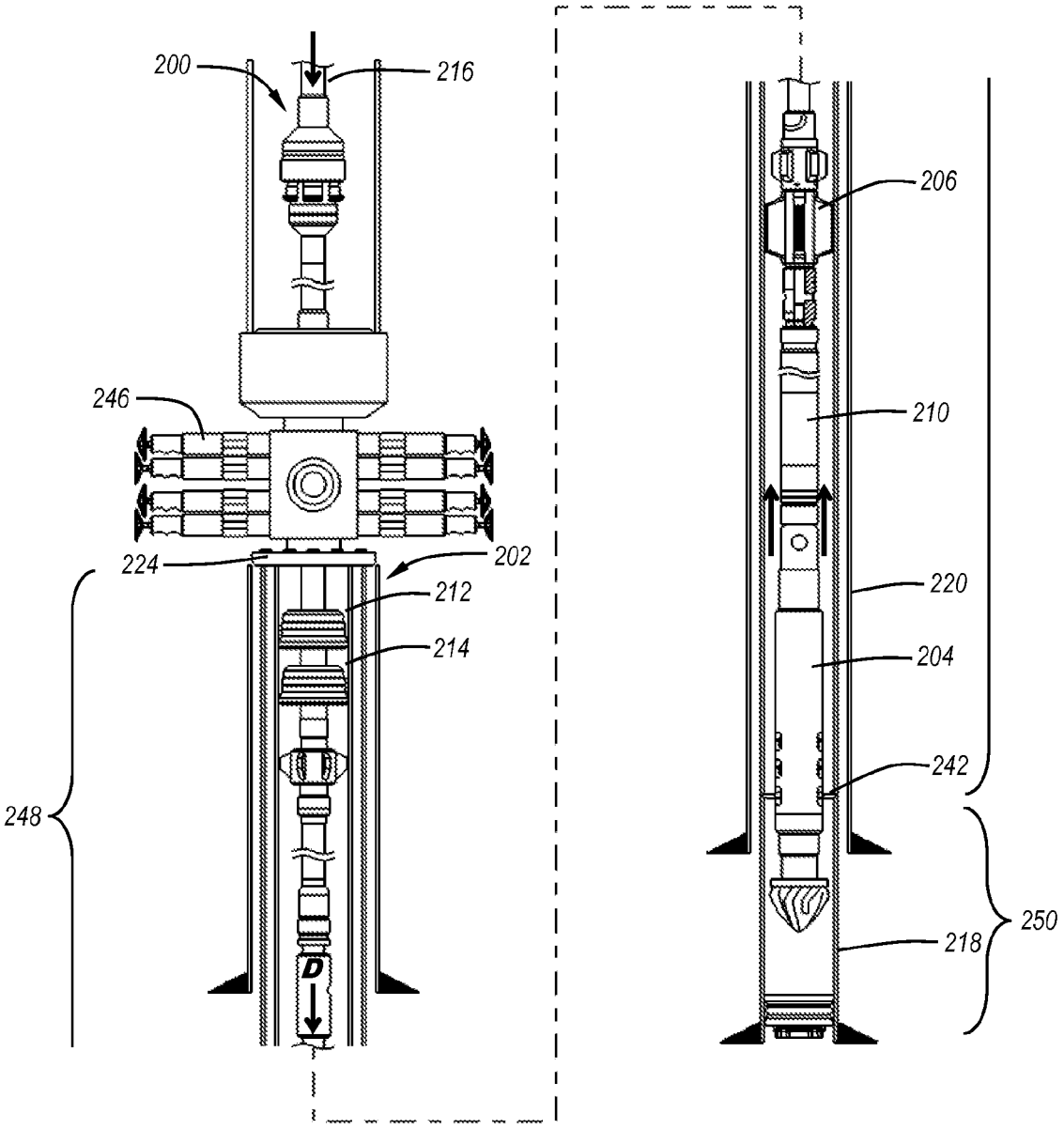
FIG. 11 schematically illustrates a side view of the downhole tool of FIG. 9, with a casing cutter cutting the casing, according to one or more embodiments of the present disclosure.

FIG. 11 schematically illustrates a side view of a casing cutter 204 cutting the first casing 218 into respective upper and lower portions 248, 250, according to one or more embodiments of the present disclosure. Once the downhole tool 200 is secured to the first casing 218 (e.g., via the spear 206), a pump (not shown) may cause drilling fluid to flow down through the work string 216 and into the downhole tool 200, as shown by the arrow D in FIG. 11. As the drilling fluid flows downward through the casing cutter 204, one or more blades 242 may expand radially-outwardly and into engagement with the first casing 218. Further, as the drilling fluid flows downwardly through a motor 210, the motor 210 may cause the casing cutter 204 to rotate about a longitudinal axis extending therethrough. When the blades 242 rotate and contact the first casing 218, the blades 242 may cut the first casing 218 into the upper portion 248 and the lower portion 250. As may be appreciated by a person having ordinary skill in the art in view of the disclosure herein, in some embodiments, the wellbore 202 may be deviated, inclined, or even horizontal. In such instances, the upper portion 248 of the first casing 218 may be the portion of the first casing 218 nearer the wellhead 224 or a blow-out preventer 246 than the so-called lower portion 250.

Once the first casing 218 has been cut into the upper and lower portions 248, 250, the pump may optionally be turned off to stop the flow of the drilling fluid through the work string 216 and the downhole tool 200. In another embodiment, the pump may remain on, and the amount or flow rate of the drilling fluid flowing through the work string 216 and/or the downhole tool 200 may be decreased. Once the downward flow of drilling fluid through the work string 216 and the downhole tool 200 decreases or stops, the blades 242 of the casing cutter 204 may be deactivated and/or the motor 210 may no longer cause the casing cutter 204 to rotate. When the blades 242 are deactivated and/or the casing cutter 204 is no longer rotated, the casing cutter 204 may be in an inactive state. In the inactive state, the blades 242 may retract radially-inwardly toward or into the body of the casing cutter 204, or may otherwise move to no longer be in contact with the first casing 218.

Figure 12:
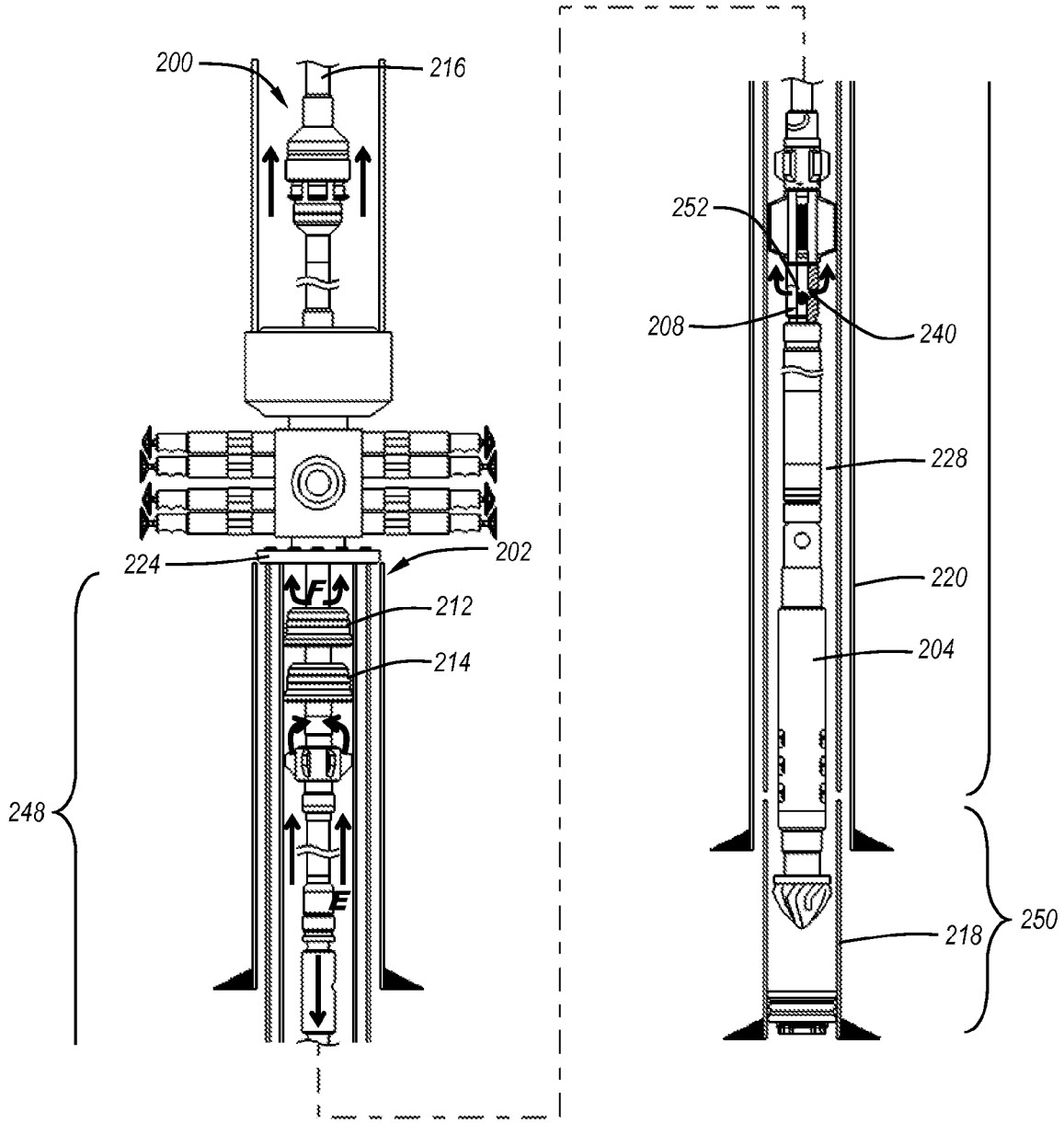
FIG. 12 schematically illustrates a side view the downhole tool of FIG. 9, with drilling fluid flowing through a port in a circulating sub and into an annulus of the wellbore, according to one or more embodiments of the present disclosure.

FIG. 12 schematically illustrates a side view of an example embodiment of the drilling tool 200 when drilling fluid flows through a port 240 in a circulating sub 132, and into a first annulus 228, according to one or more embodiments of the present disclosure. When the casing cutter 204 is in the inactive state, an impediment 252 (e.g., a ball or dart) may be introduced into the downhole tool 200. In at least one embodiment, the impediment 252 may be dropped into the work string 216 from the surface and may travel downwardly through the work string 216 and into the downhole tool 200. The impediment may come to rest in a seat disposed within the circulating sub 208, or another component coupled to the circulating sub 208 (e.g., a ball catching sub, not shown). In some embodiments, the impediment 252 may be degradable at a predetermined temperature, pressure, pH, or the like. In another embodiment, the impediment 252 may pass through the seat (e.g., when exposed to a predetermined pressure).

When the impediment 252 is in the work string 216 and potentially on the seat, the pump may once again be turned on and/or increase the drilling fluid flow rate through the work string 216 and to the downhole tool 200. The impediment 252 may obstruct the downward flow of the drilling fluid through the circulating sub 208, which may increase the pressure of the drilling fluid in the circulating sub 208 (e.g., uphole relative to the impediment 252). The increased pressure may cause one or more shear elements, such as shear pins, to break, thereby opening the one or more ports 240 in the circulating sub 208. In another embodiment, the ports 240 may be opened or uncovered via movement of a sliding sleeve or other mechanical device in response to increased pressure. Once the ports 240 are open, the drilling fluid that is pumped downward through the downhole tool 200 may flow radially-outwardly through the ports 240—which themselves may extend radially through the circulating sub 208—and into the first annulus 228 as shown by the arrows E. As shown in FIG. 12, the first annulus 228 may be the annular region existing between the downhole tool 200 and the first casing 218.

In at least one embodiment, the packoff devices 212, 214 may be actuated between a first or open state and a second or closed state. In the first or open state, the drilling fluid that flows out through the ports 240 and within the first annulus 228 may flow axially upwardly through the packoff devices 212, 214, and toward the surface, as shown by the arrows F in FIG. 12. More particularly, the drilling fluid may flow up the first annulus 228 and through the packoff devices 212, 214 toward the surface.

FIG. 13 depicts a cross-sectional view of an illustrative first packoff device 212 having an illustrative sleeve 260 disposed at least partially in a bore 234 extending through the work string 216 or mandrel 230, and positioned such that the first packoff device 212 is in an open state, according to one or more embodiments of the present disclosure. Although the first packoff device 212 is shown and described, it should be appreciated that the description of the first packoff device 212 may also apply to the second packoff device 214 and/or any additional packoff devices. The mandrel 230 (and the sleeve 260) of the first packoff device 212 may have a bore 234 formed axially therethrough. A pump (not shown) may cause drilling fluid to flow downwardly through the bore 234 as shown by arrows G. The fluid may flow through the bore 234 to other components, such as those shown in FIG. 9 (e.g., casing cutter 204, circulating sub 208, motor 210, spear 206, drill bit or mill 203, etc.).

The mandrel 230 of the first packoff device 212 may also have first and second ports 262, 264 formed radially therethrough, which ports 262, 264 may be in fluid communication with one another through an axial channel 266. A sealing element 232 may be disposed axially between the ports 260, 262, and radially between the mandrel 230 and the first casing 218.

At least a portion of the channel 266 may be formed radially between the mandrel 230 and the sleeve 260. In addition, the channel 266 may be positioned radially-inwardly relative to at least a portion of the sealing element 232. The channel 266 may provide a flow path through the first packoff device 212 such that the drilling fluid may bypass the sealing element 232 and flow upwardly through the first annulus 228, as shown by arrows H. While a single channel 266 is shown in the cross-sectional view of FIG. 13, it should be appreciated that there may be multiple axial channels (e.g., two, three, four, or more) circumferentially offset around the sleeve 260.

According to some embodiments of the present disclosure, one or more biasing members 268 (e.g., springs) may be disposed within the mandrel 230 and/or proximate the sleeve 260. The spring or other biasing member 268 may be positioned between a stop block 269, such as a stop ring, and the sleeve 260. The biasing member 268 may exert a force on the sleeve 260 that maintains the first packoff device 212 in the open state (FIG. 13) or in a closed state (FIG. 14).

FIG. 14 depicts a cross-sectional view of the first packoff device 212 of FIG. 13 having the sleeve 260 disposed therein and positioned such that the first packoff device 212 is in a closed state, according to one or more embodiments of the present disclosure. When the flow rate of the drilling fluid through the bore 234 extending through the first packoff device 212 increases beyond a predetermined level, the hydrostatic force exerted by the drilling fluid on the sleeve 260 may become greater than the opposing force exerted by the spring or other biasing member 268, and may move the sleeve 260 and compress the biasing member 268. In some embodiments, the predetermined drilling fluid flow rate that causes the sleeve 260 to move may range from about 100 L/min (0.44 gps), about 250/min (1.1 gps), or about 500 L/min (2.2 gps) to about 1,000 L/min (4.4 gps), about 2,000 L/min (8.8 gps), about 3,000 L/min (13.2 gps), or more.

Increasing the flow rate may cause the first packoff device 212 to actuate, and transition from an open state (FIG. 13) into a closed state (FIG. 14). In the closed state, the sleeve 260 may obstruct the first and/or second port 262, 264, and the drilling fluid may be restricted and potentially prevented from flowing through the channel 266. As a result, the first packoff device 212 may seal (i.e., isolate upper and lower portions of) the first annulus 228 between the first casing 228 and the mandrel 230 so that fluid is restricted, if not prevented, from flowing axially therethrough.

Figure 17:
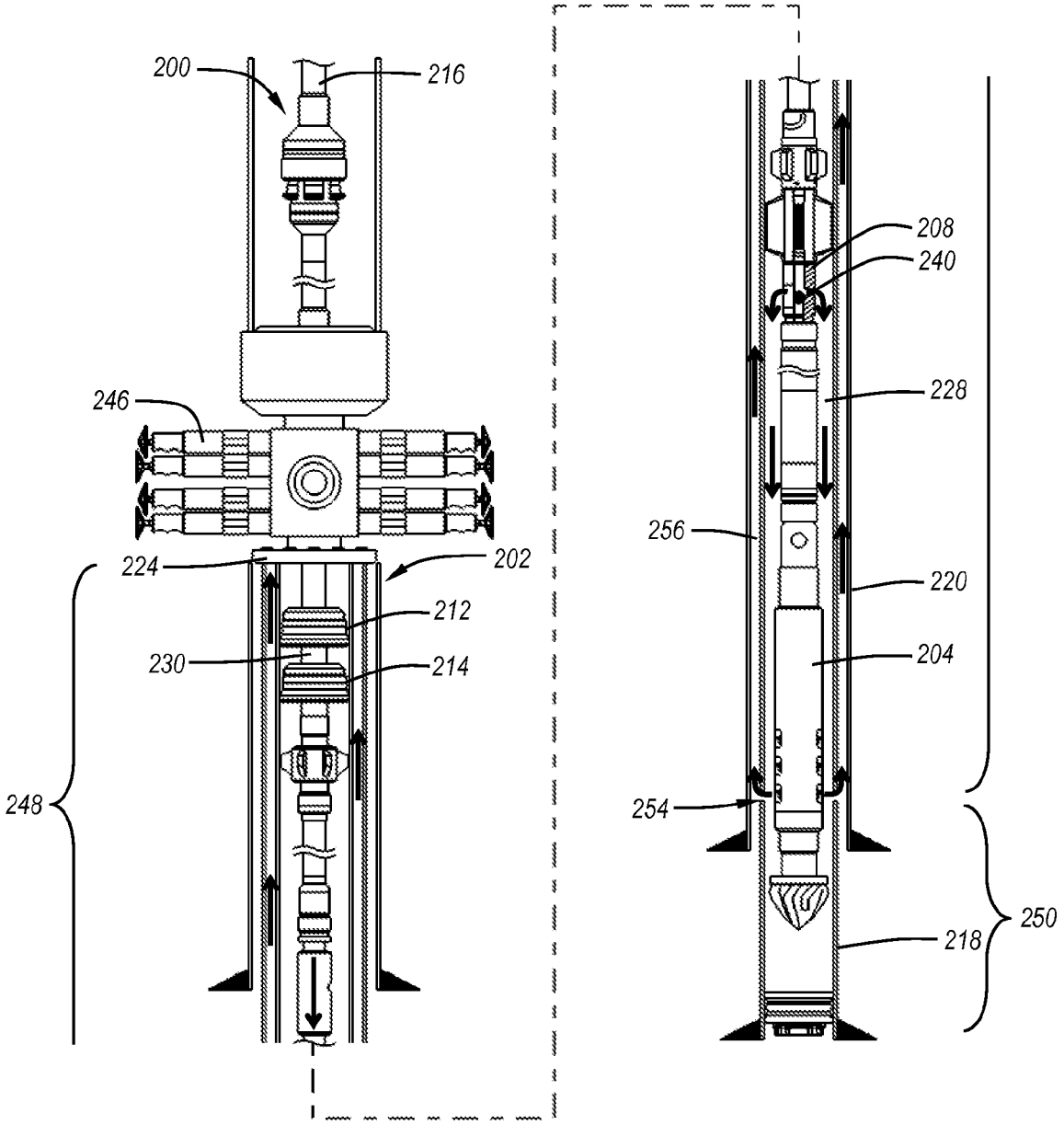
FIG. 17 schematically illustrates a side view of the downhole tool of FIG. 9, with drilling fluid flowing through the port in the circulating sub and into a second annulus of the wellbore, according to one or more embodiments of the present disclosure.

More particularly, when the first packoff device 212 actuates into the closed state, the sleeve 260 may slide or otherwise move axially within the mandrel 230 to block or obstruct the first and/or second port 262, 264. As shown, the sleeve 260 may move upwardly and obstruct the first port 262. When the sleeve 260 obstructs the first and/or second ports 262, 264, the fluid in the first annulus 228 may be diverted through an opening 254 and into a second annulus 256, as shown in FIG. 17. One or more seals 270, 272 (e.g., O-rings, T-Rings, etc.) may be disposed on an outer surface of the sleeve 260 and/or between the sleeve 260 and the mandrel 230 to limit leakage of drilling fluid when the first packoff device 212 is in the closed state.

Although FIGS. 13 and 14 illustrate an example embodiment having a single sealing element 232, other embodiments are contemplated which include multiple sealing elements 232. For instance, multiple sealing elements 232 may be positioned between the first and second ports 262, 264. An axial channel 266 between the first and second ports 262, 264 may then be used to allow fluid to bypass the multiple sealing elements 232. In other embodiments, each sealing element 232 may have its own corresponding set of first and second ports 262, 264.

FIG. 15 depicts a cross-sectional view of another illustrative sleeve 360 disposed within a first packoff device 312 and positioned such that the first packoff device 312 is in an open state, according to one or more embodiments of the present disclosure. In at least one embodiment, the sleeve 360 may have a seat 374 coupled thereto or integral therewith. The seat 374 may extend radially-inwardly from the inner surface of the sleeve 360 in some embodiments. When there is no impediment engaged with the seat 374, the drilling fluid may flow downwardly through the bore 334, as shown by arrows G, as well as upwardly through the channel 366 and through a first annulus 328, as shown by arrows H.

FIG. 16 depicts a cross-sectional view of the first packoff device 312 of FIG. 15 having the sleeve 360 disposed therein and positioned such that the first packoff device 312 is in a closed state, according to one or more embodiments of the present disclosure. An impediment 376 may be introduced to the bore 334 of the first packoff device 312. For example, the impediment 376 may be dropped into a drill pipe or work string from the surface, and flowed down through a downhole tool and into the bore 334 of the first packoff device 312. The impediment 376 may be a ball, a dart, or the like, and may be sized and/or shaped to be received in the seat 374. The impediment 376 may be degradable at a predetermined temperature, pressure, pH, or the like. When the impediment 376 is engaged with the seat 374, downward flow of the drilling fluid may be obstructed through the bore 334.

When the bore 334 is obstructed, the pressure of the drilling fluid in the bore 334 may increase behind (i.e., uphole of) the impediment 376, and the hydrostatic force exerted by the drilling fluid on the sleeve 360 may become greater than the opposing force exerted by a biasing member 368 positioned between the sleeve 360 and a stop block 369. This may cause the sleeve 360 to slide or otherwise move axially within or along a mandrel 330, compressing the biasing member 368 and blocking or obstructing the first and/or second ports 362, 364, thereby actuating the first packoff device 312 so as to cause a transition from an open state to a closed state. As shown, the sleeve 360 may move downwardly and obstruct the second port 364. When the sleeve 360 blocks or obstructs the first and/or second port 362, 364 (i.e., the when first packoff device 312 is in a closed state), drilling fluid may be restricted or even prevented from flowing upwardly through the one or more channels 366 and into the first annulus 328. When this occurs, the first packoff device 312 may seal a first annulus 328 between the first casing 318 and the mandrel 330 so that fluid is restricted or potentially prevented from flowing axially therethrough.

In some embodiments, the sleeve 360 may be configured to be secured in position to maintain the first packoff device 312 in the closed state. For example, the sleeve 360 may include a radial protrusion 378 disposed on the outer surface thereof, and the mandrel 330 may have a groove 380 disposed on the inner surface thereof. The protrusion 378 may engage the groove 380 when the sleeve 360 moves (e.g., downwardly as shown in FIG. 16). In another embodiment, the sleeve 360 may have a groove 380 disposed on the outer surface thereof, and the mandrel 330 may have a radial protrusion 378 disposed on the inner surface thereof. Once the protrusion 378 is within the groove 380 and the sleeve 360 is secured in place, the impediment 376 may degrade, or the pressure of the fluid in the bore 334 may be increased until the seat 374 and/or the impediment 376 deforms, thereby allowing the impediment 376 to pass through the seat 374.

When two or more packoff devices are used (e.g., packoff devices 212, 214 in FIGS. 9-12), an impediment 376 that engages the seat 374 in the lower packoff device may be smaller than the impediment 376 that engages the seat 374 in the upper packoff device. This arrangement may allow the first impediment 376 to pass through the upper packoff device and engage the seat 374 in the lower packoff device. In other embodiments, a single one of the multiple packoff devices may use an impediment (e.g., one packoff device may be configured similar to the packoff device 212 of FIGS. 13 and 14, while another packoff device may be configured similar to the packoff device 312 of FIGS. 15 and 16).

FIG. 17 schematically illustrates a side view of the downhole tool 200 in which drilling fluid may flow through the port(s) 240 in the circulating sub 208 and into a second annulus 256, according to one or more embodiments of the present disclosure. When a sleeve (e.g., sleeve 260 of FIGS. 13 and 14 or sleeve 360 of FIGS. 15 and 16) obstructs the flow of drilling fluid through a channel in the packoff devices 212, 214 (e.g., channels 266, 366) due to an increase in the flow rate of the drilling fluid through a bore 234 (as shown in FIG. 14) and/or an impediment 376 being received in a seat 374 (as shown in FIG. 16), the packoff devices 212, 214 may seal the first annulus 228 between the first casing 218 and the mandrel 230. When this occurs, the drilling fluid flowing through the ports 240 in the circulating sub 208 and into the first annulus 228 may no longer flow up and out of the first annulus 228, as shown in FIG. 12. Rather, the drilling fluid may now flow from the first annulus 228, through the opening 254 formed by the casing cutter 204 between the upper and lower portions 248, 250 of the first casing 218, and into the second annulus 256 formed between the first casing 218 and the second casing 220.

At least a portion of the drilling fluid flowing into the second annulus 256 may flow upwardly and out of the second annulus 256. For example, drilling fluid may flow upwardly and out of the second annulus 256 through a blow-out preventer 246 and/or through one or more so-called "kill lines" (not shown). The drilling fluid flowing through the second annulus 256 may circulate or flush any existing fluids in the second annulus 256 out of the second annulus 256, leaving the second annulus 256 filled with clean or new drilling fluid. The fluids that are disposed in the second annulus 256 before being flushed out by the drilling fluid (i.e., the "existing fluids") may include liquid hydrocarbons, gaseous hydrocarbons, or any other fluid present in the wellbore 202 or the surrounding formation.

In addition to flushing the existing fluids out of the second annulus 256, the flow of the drilling fluid through the second annulus 256 may, at least partially, erode physical bonds (e.g., barite) formed between the upper portion 248 of the first casing 218 and the second casing 220 that would otherwise hinder removal of the upper portion 248 of the first casing 218. For example, the drilling fluid may include one or more additives designed to erode the physical bonds formed between the upper portion 248 of the first casing 218 and the second casing 220.

Figure 18:
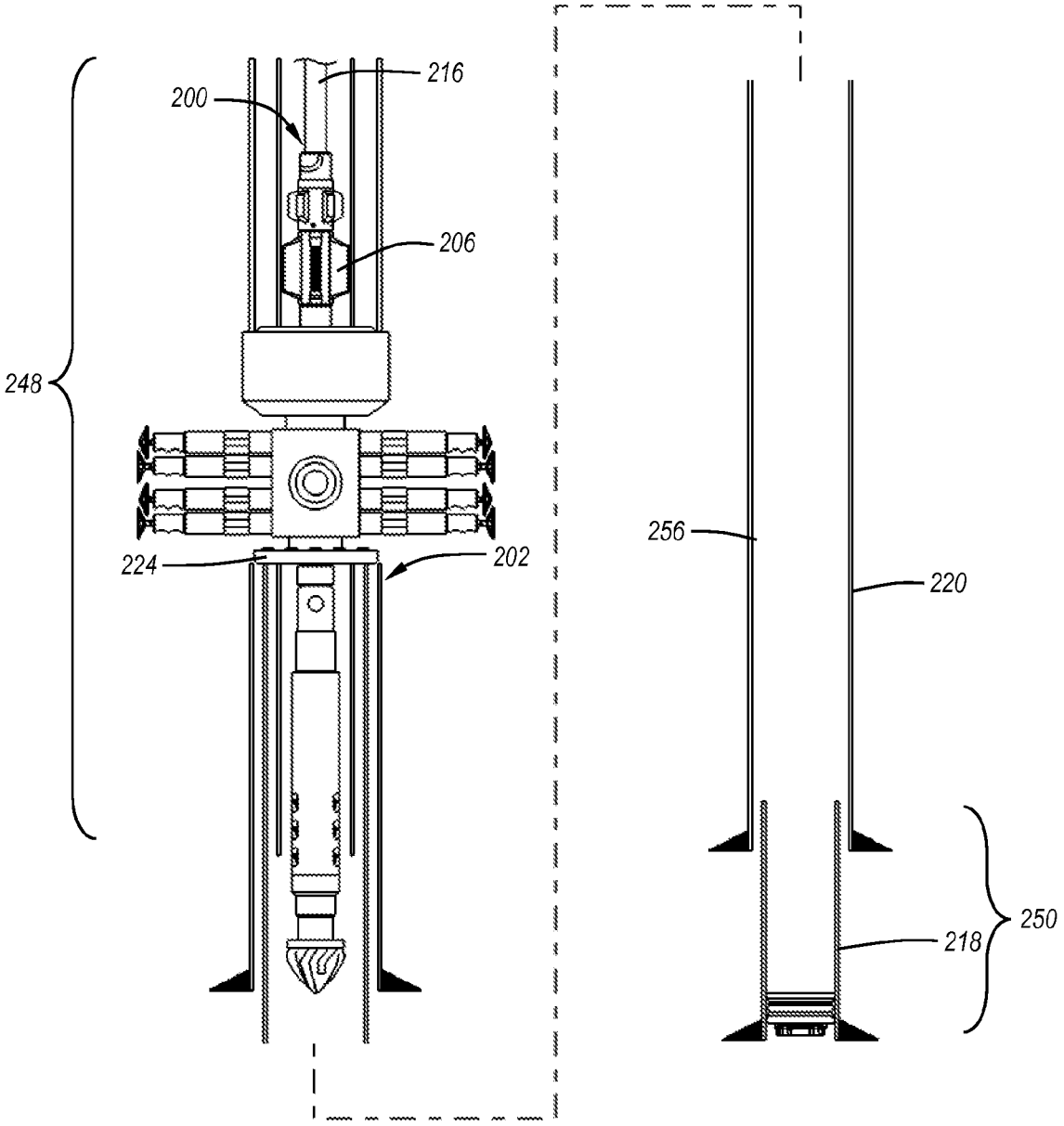
FIG. 18 schematically illustrates a side view of the downhole tool of FIG. 9 when pulling the upper portion of the first casing out of the wellbore, according to one or more embodiments of the present disclosure.

FIG. 18 schematically illustrates a side view of the downhole tool 200 pulling the upper portion 248 of the first casing 218 out of the wellbore 202, according to one or more embodiments of the present disclosure. The spear 206 may still be engaged with the upper portion 248 of the first casing 218 as the drilling fluid circulates through the second annulus 256. After circulation is complete, the work string 216 may raise the downhole tool 200 and the upper portion 248 of the first casing 218, which may be coupled to the downhole tool 200 via the spear 206. The downhole tool 200 and the upper portion 248 of the first casing 218 may be raised up and out of the wellbore 202. The wellbore 202 may then be filled in with surrounding formation materials (e.g., sand or mud).

As should be appreciated by one having ordinary skill in the art in view of the present disclosure, the downhole tool 200 may be capable of completing a process that includes cutting the first casing 218, flushing the existing fluids out of second annulus 256, and removing the upper portion 248 of the first casing 218 from the wellbore 202 in a single trip. In addition, by incorporating a bypass channel (e.g., channels 266 and 366 of FIGS. 13-16) and sleeve (e.g., sleeves 260, 360 of FIGS. 13-16) into the packoff devices 212, 214, the downhole tool 200 may remain substantially stationary with respect to the upper portion 248 of the first casing 218 from the time the spear 206 engages the first casing 218 until the time the upper portion 248 of the first casing 218 is removed from the wellbore 202. In other words, the embodiments of FIGS. 9-18 may allow the downhole tool 202 to remove the upper portion 248 of the first casing 218 potentially without disengaging the spear 206 to allow movement of the casing cutter 104. Further, rather than potentially cutting the casing while the packoff devices 212, 214 are outside the wellbore 202, the packoff devices 212, 214 may be initially located within the wellbore 202 prior to engaging the spear 206 and/or cutting the first casing 218.

According to some embodiments of the present disclosure, a packoff device is disclosed which includes a mandrel, sealing element, and sleeve. The mandrel may have an axial bore and first and second ports extending radially from the axial bore. The sealing element may extend radially-outwardly from the mandrel and may be positioned axially between the first and second ports. The sleeve may be disposed at least partially within the axial bore, the sleeve and the mandrel defining a channel providing a path of fluid communication between the first and second ports, and the sleeve being configured to move from an open state in which the first and second ports are unobstructed by the sleeve to a closed state in which at least one of the first port or the second port is obstructed by the sleeve.

A packoff device according to some embodiments may further include a biasing member within the bore, which biasing member may exert a force on the sleeve to bias the sleeve in the open state.

A sleeve of a packoff device according to some embodiments may be configured to move from the open state to the closed state when a flow rate of fluid through the axial bore exceeds a predetermined level. In some embodiments, the predetermined level may be between about 100 L/min and about 3,000 L/min.

A packoff device according to some embodiments may further include a seat coupled to the sleeve, with the seat being configured to receive an impediment introduced into the axial bore. A sleeve of a packoff device according to some embodiments may be configured to move from the open state to the closed state when the impediment is received in the seat. In the same or other embodiments, a sleeve of a packoff device may be configured to permit fluid to flow through the first port, the channel, and the second port when the sleeve is in the open state, thereby bypassing the sealing element.

A sealing element of a packoff device according to some embodiments may be configured to isolate upper and lower portions of an annulus formed between the mandrel and a casing positioned radially-outwardly relative to the mandrel.

In accordance with other embodiments of the present disclosure, a downhole tool for removing a portion of a casing from a wellbore may include a packoff device, spear, circulating sub, and casing cutter. The packoff device may include a mandrel, sealing element, and sleeve. The mandrel may have an axial bore and axially offset first and second radial ports. The sealing element may be coupled to the mandrel and configured to isolate an annulus formed between the mandrel and a casing. The sleeve may be disposed at least partially within the axial bore, and the sleeve and mandrel may form a channel providing a path of fluid communication between the first and second radial ports. The sleeve may be configured to move between an open state in which the first and second radial ports are unobstructed by the sleeve and a closed state in which the first radial port, the second radial port, or both are obstructed by the sleeve. The spear of the downhole tool may be coupled to the packoff device and adapted to engage the casing to restrict relative movement between the downhole tool and the casing. The circulating sub may be coupled to the spear and may have a port in fluid communication with the annulus. The casing cutter may be coupled to circulating sub and configured to rotate to cut the casing.

A sealing element of a packoff device of a downhole too may, according to some embodiments be adapted to isolate upper and lower portions of the annulus. A sleeve may be configured to permit fluid to flow through the first radial port, the channel, and the second radial port when the sleeve is in the open state, thereby bypassing the sealing element. In some embodiments, the packoff device may be positioned axially above the spear, circulating sub, and the casing cutter. Further, a downhole tool may include a seat coupled to the sleeve, the seat being configured to receive an impediment introduced to the axial bore.

A method for removing a casing from a wellbore may, according to some embodiments of the present disclosure, include running a downhole tool into a first casing, the downhole tool including a packoff device, a spear, a circulating sub, and a casing cutter. The first casing may be engaged with the spear to restrict relative movement between the downhole tool and the first casing, and the first casing may be cut to form an opening between upper and lower portions of the first casing. At least a portion of a first annulus defined between the downhole tool and the first casing may be isolated by using the packoff device. The packoff device may include a mandrel having an axial bore and first and second radial ports, a sealing element coupled to the mandrel and extending radially-outwardly from the mandrel to contact the first casing, and a sleeve disposed at least partially within the axial bore. The sleeve and the mandrel may define a channel that provides a path of fluid communication between the first and second radial ports, the first and second radial ports being unobstructed by the sleeve when the packoff device in an open state, and the first radial port, the second radial port, or both being obstructed by the sleeve in a closed state. The method may also include flowing a drilling fluid through a port in the circulating sub and into the first annulus, at least a portion of the drilling fluid flowing from the first annulus, through the opening formed between the upper and lower portions of the first casing, and into a second annulus formed between the first casing and a second casing. The upper portion of the first casing may also be pulled out of the wellbore after the drilling fluid flows into the second annulus.

According to some embodiments, flowing the drilling fluid may include flushing existing fluid in the second annulus out of the second annulus with the drilling fluid, and during a same downhole trip that includes cutting the first casing. A packoff device used in a method for removing casing from a wellbore may provide a fluid bypass in the open state, thereby permitting fluid to bypass the sealing element. In some embodiments, the packoff device may close the fluid bypass in the closed state, thereby restricting fluid from bypassing the sealing element.

A method of some embodiments of the present disclosure may include isolating at least a portion of the first annulus by actuating the packoff device from the open state to the closed state in response to increasing a flow rate of drilling fluid through the axial bore of the mandrel beyond a predetermined level. Isolating may include actuating the packoff device from the open state to the closed state in response to an impediment being introduced to the bore of the mandrel and engaging a seat coupled to the sleeve. In some embodiments, the sealing element may be positioned axially between first and second radial ports.

As used herein, the terms "inner" and "outer"; "up" and "down"; "upper" and "lower"; "upward" and "downward"; "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with," "integral with," or "in connection with via one or more intermediate elements or members."

Although various example embodiments have been described in detail herein, those skilled in the art will readily appreciate in view of the present disclosure that many modifications are possible in the example embodiment without materially departing from the present disclosure. Accordingly, any such modifications are intended to be included in the scope of this disclosure. Likewise, while the disclosure herein contains many specifics, these specifics should not be construed as limiting the scope of the disclosure or of any of the appended claims, but merely as providing information pertinent to one or more specific embodiments that may fall within the scope of the disclosure and the appended claims. Any described features from the various embodiments disclosed may be employed in combination. In addition, other embodiments of the present disclosure may also be devised which lie within the scopes of the disclosure and the appended claims. Each addition, deletion, and modification to the embodiments that falls within the meaning and scope of the claims is to be embraced by the claims.

In the claims, means-plus-function clauses are intended to cover the structures described herein as performing the recited function, including both structural equivalents and equivalent structures. Thus, although a nail and a screw may not be structural equivalents in that a nail employs a cylindrical surface to couple wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

Certain embodiments and features may have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges may appear in one or more claims below. Any numerical value is "about" or "approximately" the indicated value, and take into account experimental error and variations that would be expected by a person having ordinary skill in the art.

What is claimed is:

1. A downhole tool for removing a portion of a casing from a wellbore, comprising:

a packoff device configured to selectively change from a first configuration in which flow is allowed through the packoff device to a second configuration blocking flow through the packoff device, the packoff device including a sealing element configured to seal an annulus formed between the downhole tool and a casing in a wellbore while the packoff device is in the first and second configurations;

a spear coupled to the packoff device and configured to engage the casing to restrict relative movement between the downhole tool and the casing;

a circulating sub coupled to the spear, the circulating sub having a port therein, the port extending at least partially in a radial direction and configured to be in fluid communication with the annulus; and a casing cutter coupled to the circulating sub and configured to cut the casing, wherein the packoff device is positioned above the spear, the circulating sub, and the casing cutter.

2. The downhole tool of claim 1, the packoff device being configured to:

in the first configuration, allow fluid flow from the annulus below the sealing element to enter the packoff device, and to allow fluid flow entering the packoff device to flow out of the packoff device into the annulus above the sealing element; and in the second configuration, allow fluid flow from the annulus below the sealing element to enter into the packoff device, and to block flow out of the packoff device into the annulus above the sealing element.

3. The downhole tool of claim 1, the sealing element of the packoff device comprising one or more swab cups.

4. The downhole tool of claim 1, the packoff device comprising:

a mandrel having a bore therein; and a sleeve that is movable relative to the mandrel, the sleeve being movable from a first position and a second position, wherein:

when the sleeve in the first position, drilling fluid that flows in the bore and into the annulus below the sealing element is permitted to also flow from the annulus below the sealing element to the annulus above the sealing element through a fluid flow path extending through the sealing element; and when the sleeve is in the second position, drilling fluid that flows in the bore and into the annulus below the sealing element is blocked from also flowing from the annulus below the sealing element to the annulus above the sealing element through the fluid flow path extending through the sealing element.

5. The downhole tool of claim 4, the sealing element comprising one or more sealing lips facing downwardly toward the casing cutter.

6. The downhole tool of claim 1, the packoff device comprising two or more packoff devices that are axially offset from one another.

7. The downhole tool of claim 4, the fluid flow path being radially-outward of the bore of the mandrel.

8. The downhole tool of claim 4, the casing cutter being configured to cut the casing into upper and lower portions, an opening formed between the upper and lower portions of the casing permitting at least a portion of the drilling fluid to flow therethrough and into an annulus formed between the casing and a second casing.

9. The downhole tool recited in claim 1, further comprising:

a motor coupled to the casing cutter and configured to rotate the casing cutter to cut the casing.

10. A method for removing a casing from a wellbore, comprising:

running a downhole tool into a first casing, the downhole tool including a packoff device, a spear, and a casing cutter;

engaging the first casing with the spear to restrict relative movement between the downhole tool and the first casing;

cutting the first casing into upper and lower portions with the casing cutter, thereby forming an opening in the first casing;

sealing a first annulus between the downhole tool and the first casing with the packoff device by engaging a sealing element with the first casing, the packoff device being positioned above the spear and the casing cutter;

flowing a drilling fluid through the packoff device and into the first annulus, at least a portion of the drilling fluid bypassing the sealing element and flowing from a portion of the first annulus below the sealing element to a portion of the first annulus above the sealing element by flowing through a fluid flow path extending through the sealing element;

actuating the packoff device and blocking flow of the drilling fluid from the portion of the first annulus below the sealing element to the portion of the first annulus above the sealing element through the fluid flow path extending through the sealing element, wherein blocking flow of the drilling fluid includes flowing the drilling fluid through the opening formed between the upper and lower portions of the first casing, and into a second annulus formed between the first casing and a second casing; and pulling the upper portion of the first casing out of the wellbore after the drilling fluid flows into the second annulus.

11. The method of claim 10, wherein the downhole tool is arranged to include:

the spear coupled to, and positioned on the downhole tool between, the packoff device and a circulating sub; and the casing cutter coupled to and positioned below the circulating sub.

12. The method of claim 10, the downhole tool further including a motor coupled to the casing cutter, wherein cutting the first casing further includes using the motor to rotate the casing cutter about a longitudinal axis extending therethrough.

13. The method of claim 10, wherein pulling the upper portion of the first casing out of the wellbore further includes engaging the spear with the upper portion of the first casing after the drilling fluid flows into the second annulus.

14. The method of claim 10, further comprising flushing existing fluid in the second annulus out of the second annulus with the drilling fluid.

15. The method of claim 10, wherein the drilling fluid includes one or more of air, a mixture of air and water, a mixture of air and a polymer, water, water-based mud, oil-based mud, or synthetic-based fluid.

16. A method for removing a casing from a wellbore, comprising:

running a downhole tool into a first casing, the downhole tool including a packoff device, a spear, a circulating sub, and a casing cutter;

activating the spear to restrict relative movement between the downhole tool and the first casing;

after activating the spear, using the casing cutter to form an opening in the first casing, the opening separating the first casing into upper and lower portions;

opening a port in the circulating sub, the circulating sub being positioned between the spear and the casing cutter, and the port providing a path of fluid communication between an axial bore formed through the downhole tool and a first annulus formed between the downhole tool and the first casing;

deactivating the spear to allow relative movement between the downhole tool and the first casing after the port is opened;

after deactivating the spear, moving the downhole tool with respect to the first casing;

sealing the first annulus with the packoff device, the packoff device being positioned above the spear;

flowing a drilling fluid through the port in the circulating sub and into the first annulus when the packoff device seals the first annulus, wherein at least a portion of the drilling fluid flows from the first annulus, through the opening formed between the upper and lower portions of the first casing, and into a second annulus formed between the first casing and a second casing;

activating the spear again to restrict relative movement between the downhole tool and the upper portion of the first casing after the drilling fluid flows into the second annulus; and pulling the upper portion of the first casing out of the wellbore after the spear is engaged with the upper portion of the first casing.

17. The method of claim 16, wherein:

the spear is coupled to and positioned between the packoff device and the circulating sub; and the casing cutter is coupled to and positioned below the circulating sub.

18. The method of claim 16, wherein opening the port further comprises:

introducing an impediment into the downhole tool, the impediment engaging a seat disposed within the downhole tool and forming a seal therewith;

with the impediment engaging the seat, increasing a pressure of the drilling fluid in the circulating sub; and opening the port in response to the increased pressure of the drilling fluid.

19. The method of claim 16, wherein flowing the drilling fluid through the port in the circulating sub further includes flushing existing fluid in the second annulus out of the second annulus.

20. The method of claim 16, wherein moving the downhole tool with respect to the first casing further comprises lowering the downhole tool with respect to the first casing to dispose the packoff device within the first annulus.

* * * * *